US005294963A

United States Patent [19]

Nakano et al.

[11] Patent Number: 5,294,963

[45] Date of Patent: Mar. 15, 1994

[54] TONER CARTRIDGE HAVING OPENING FOR DISCHARGING TONER SEALED WITH SEALING MEMBER AND METHOD OF STRIPPING SEALING MEMBER

[75] Inventors: Kuniaki Nakano, Nara; Yasuyuki Hirai, Yao; Masahiro Higashitani; Yasuhiro Matsuo, both of Osaka; Shingo Mori, Nara; Hiromi Sakata, Suita; Masahiro Sako, Hirakata; Minoru Kishigami, Osaka, all of Japan

[73] Assignee: Mita Industrial Co., Ltd., Osaka, Japan

[21] Appl. No.: 865,098

[22] Filed: Apr. 8, 1992

[30] Foreign Application Priority Data

Apr. 19, 1991 [JP] Japan ..... 3-088776
Jun. 18, 1991 [JP] Japan ..... 3-174419

[51] Int. Cl.[5] ..... G03G 15/08

[52] U.S. Cl. ..... 355/260; 141/364; 220/258; 229/125.05

[58] Field of Search ..... 355/260; 222/DIG. 1; 141/364; 220/258, 346; 229/125.05, 125.12; 206/216

[56] References Cited

U.S. PATENT DOCUMENTS 4,650,070 3/1987 Oka et al. ..... 222/DIG. 1 X
4,834,246 5/1989 Inoue et al. ..... 220/258 X

FOREIGN PATENT DOCUMENTS 54-28447 2/1979 Japan .
59-41364 3/1984 Japan .
59-41365 3/1984 Japan .
63-132962 8/1988 Japan .
63-249870 10/1988 Japan ..... 355/260
1-280781 11/1989 Japan .
1-60142 12/1989 Japan .

*Primary Examiner*—Joan H. Pendegrass
*Attorney, Agent, or Firm*—Beveridge, DeGrandi, Weilacher & Young

[57] ABSTRACT

An opening for discharging toner is formed in a lower part of a cartridge body containing toner. A shutter mounting body is mounted on the opening. A first shutter is slidably mounted on the shutter mounting body. A second shutter is slidably mounted on the first shutter. A front end of a sealing member for sealing the opening is extended, the extended front end being inserted through a seal traction opening formed in a front end of the second shutter, and fixed to a front end of the first shutter. When the second shutter is pulled out of the shutter mounting body, the sealing member is towed by the seal traction opening. In addition, the first shutter is further towed by the sealing member, to be also pulled out. Consequently, nearly half of the sealing member from its front end is stripped. When the second shutter is further pulled out after the movement of the first shutter is regulated, the seal traction opening in the second shutter tows the sealing member while allowing the insertion of the sealing member. At this time, the sealing member is stripped while being so folded that a toner adhering surface is located in its inside. In this construction, the stroke for stripping is decreased, thereby to make it possible to prevent contamination by toner as well as prevent a large part of the sealing member from being ineffective.

40 Claims, 27 Drawing Sheets

TONER CARTRIDGE HAVING OPENING FOR DISCHARGING TONER SEALED WITH SEALING MEMBER AND METHOD OF STRIPPING SEALING MEMBER

BACKGROUND OF THE INVENTION

1. Field of the Invention

The present invention relates to a toner cartridge applied to an electrostatic process image forming apparatus such as an electrophotographic copying machine for supplying toner for visualizing an electrostatic image.

2. Description of the Prior Art

In an electrostatic process image forming apparatus such as an electrostatic process copying machine and a laser beam printer, an image is formed in the following manner. More specifically, the surface of a photoreceptor uniformly charged is exposed corresponding to an image to be formed. Consequently, an electrostatic latent image corresponding to an image to be recorded is formed on the surface of the photoreceptor. The electrostatic latent image is developed into a toner image by a developing device. The toner image is transferred to paper, and the toner image transferred is further fixed on the paper, to complete printing.

Toner is supplied to the developing device from a toner hopper inside of the image forming apparatus. The toner in the toner hopper is consumed as the image is formed. Consequently, when there is no toner left in the toner hopper, toner must be supplied. It is a toner cartridge that is used so as to supply the toner.

Examples of the toner cartridge conventionally used include a toner cartridge in which an opening of a cartridge body which is a container for containing a constant amount of toner is sealed by affixing a film-shaped sealing member. At the time of supplying toner, the toner cartridge is mounted on the toner hopper, so that the sealing member is stripped. Consequently, the toner in the cartridge body is supplied to the toner hopper through the opening.

Such a toner cartridge is disclosed in, for example, Japanese Utility Model Laid-Open Gazette No. 28447/1979. In the prior art disclosed in the gazette, a sealing member is folded in one end of an opening of a cartridge body, and is extended to the other end of the opening. After the toner cartridge is mounted on a toner hopper, a worker pulls out a front end of the sealing member folded. Consequently, the sealing member is stripped from the one end of the above described opening to the other end thereof.

In the prior art, however, a surface to which toner adheres of the sealing member is exposed, resulting in contamination by toner. More specifically, the toner adhering to the surface of the sealing member is scattered, to make clothes of the worker and peripheral devices dirty. Further, in the prior art, the front end of the sealing member must be pulled out over a length which is twice the length of the opening so as to completely open the opening of the cartridge body. That is, the stroke for stripping is long. In addition, a sealing member having a length which is twice the length of the opening is required, so that a large part of the sealing member is ineffective.

Japanese Utility Model Laid-Open Gazette No. 41364/1984 discloses the prior art in which the problem of contamination by toner is overcome. More specifically, in the prior art, a sealing member is covered with a slide cover slid along an opening of a cartridge body. The slide cover is first pulled out and then, the sealing member is pulled out. At this time, a toner adhering surface of the sealing member is opposed to the slide cover. Consequently, the toner adhering surface of the sealing member is shielded by the slide cover, thereby to make it possible to prevent the contamination by toner. In the prior art, however, a state where the sealing member is disposed is the same as that in Japanese Utility Model Laid-Open Gazette No. 28447/1979, so that the problem that the stroke for stripping is long and the problem that a large part of the sealing member is ineffective are not improved.

The other prior art in which the problem of contamination by toner is overcome is disclosed in Japanese Utility Model Laid-Open Gazette No. 132962/1988. The toner cartridge disclosed in this gazette is provided with a shutter for opening or closing an opening of a cartridge body. An extended part connecting with a part where the opening is sealed of the sealing member is led to a lower surface of the shutter, and is further led to a portion between the opening and the shutter through a first slit formed in a front end of the shutter. The extended part of the sealing member between the opening and the shutter is further led to the lower surface of the shutter through a second slit formed in a rear end of the shutter and then, is led to an upper surface of the shutter again through a third slit formed on the rear end side of the second slit. A front end of the extended part of the sealing member adheres to a peripheral edge part of the opening of the toner cartridge.

When the shutter is pulled out of the cartridge body, the sealing member is towed by the third slit while being moved through the first, second and third slits. Consequently, the sealing member is stripped from the opening. At this time, a toner adhering surface is opposed to the upper surface of the shutter, so that there occurs no problem of contamination by toner.

Also in this prior art, however, the problem that the stroke for stripping is long and the problem that a large part of the sealing member is ineffective are not solved.

On the other hand, Japanese Utility Model Laid-Open Gazette No. 41365/1984 discloses the still other prior art. In a toner cartridge disclosed in this gazette, a state where a sealing member is disposed is the same as that in the toner cartridge disclosed in Japanese Utility Model Laid-Open Gazette No. 28447/1979. In addition, a slide cover is provided in the same manner as that in the toner cartridge disclosed in Japanese Utility Model Laid-Open Gazette No. 41364/1984. The toner cartridge differs from the toner cartridge disclosed in Japanese Utility Model Laid-Open Gazette No. 41364/1984 in that a front end of a sealing member folded adheres to an upper surface of the slide cover. If the slide cover is completely pulled out, the sealing member is stripped to the middle of the opening. At this time, the sealing member is exposed to the upper surface of the slide cover. Accordingly, a worker takes the exposed part of the sealing member in his hand to pull the same, thereby to make it possible to completely strip the sealing member from the opening.

In the prior art, the stroke length required to strip the sealing member is reduced to approximately 1.5 times the length of the opening. However, a worker must directly take a part to which toner adheres of the sealing member, so that the hand and clothes are liable to be dirty. Accordingly, the problem of contamination by toner cannot be avoided. In addition, the problem that a large part of the sealing member is ineffective is not solved.

The prior art for reducing the stroke length is also disclosed in Japanese Patent Publication No. 60142/1989 and Japanese Patent Laid-Open Gazette No. 280781/1989. In a toner cartridge disclosed in Japanese Patent Publication No. 60142/1989, a sealing member is formed in a loop shape. In addition, there is provided a slidable shutter for opening or closing an opening of a cartridge body, and the shutter is disposed so as to be enclosed by the sealing member. If the shutter is slid, a loop of the sealing member follows the shutter, so that the sealing member is stripped in a direction to slide the shutter. Consequently, the shutter is slid by a length equal to the length of the opening, thereby to make it possible to completely strip the sealing member. In the above described manner, the stroke length becomes approximately equal to the length of the opening.

In the prior art disclosed in Japanese Patent Laid-Open Gazette No. 280781/1989, a shutter is provided slidably with respect to an opening of a cartridge body. In addition, a sealing member is disposed with it being folded in the same manner as that in the toner cartridge disclosed in Japanese Utility Model Laid-Open Gazette No. 28447/1979, and a front end of the sealing member adheres to the cartridge body through a hole formed in the shutter. The operation in the prior art is approximately the same as the operation disclosed in Japanese Patent Publication No. 60142/1989.

In the prior art disclosed in Japanese Patent Publication No. 60142/1989 and the prior art disclosed in Japanese Patent Laid-Open Gazette No. 280781/1989, a toner adhering surface of the sealing member is exposed to the lower surface as the shutter is slid. Consequently, toner is liable to be dropped, so that the problem of contamination by toner is unavoidable. Moreover, the sealing member must have a length which is twice the length of the opening.

The above described Japanese Patent Publication No. 60142/1989 also discloses a toner cartridge so adapted that a pulley is provided in each of a front end and a rear end of the shutter, the loop-shaped sealing member is wound around the pulley, and the loop of the sealing member is formed between the shutter and the opening of a cartridge body. In this toner cartridge, the toner adhering surface of the sealing member enters a portion between the opening of the cartridge body and the shutter, so that the problem of contamination by toner is restrained. However, the problem that a large part of the sealing member is ineffective cannot be avoided even by the prior art.

SUMMARY OF THE INVENTION

An object of the present invention is to provide a toner cartridge capable of reducing the stroke for stripping a sealing member.

Another object of the present invention is to provide a toner cartridge capable of preventing contamination by toner.

Still another object of the present invention is to provide a toner cartridge capable of reducing the load of toner supplying work.

Still another object of the present invention is to provide a toner cartridge capable of decreasing the length of a sealing member to prevent a large part of the sealing member from being ineffective.

A further object of the present invention is to provide a method of stripping a sealing member for sealing an opening of a toner cartridge capable of decreasing the stroke for stripping the sealing member to reduce the load of stripping work of the sealing member as well as preventing contamination by toner.

A still further object of the present invention is to provide a method of stripping a sealing member for sealing an opening of a toner cartridge capable of decreasing the length of the sealing member.

In the present invention, there are provided a first shutter and a second shutter which are slid along an opening for discharging toner formed in a cartridge body. For example, when the second shutter is slid to be pulled out of the cartridge body, the first shutter is slid in synchronism with the second shutter. The process of stripping a sealing member comprises a first stripping process in which a position for stripping is in the range from a position where stripping is started to a middle position for stripping, and a second stripping process in which a position for stripping is in the range from the middle position for stripping to a position where stripping is completed. In the first stripping process, the sealing member is pulled out, beginning at its front end. In the second stripping process, the sealing member is pulled out, beginning at its middle part. In the second stripping process, the sealing member is so folded that its toner adhering surface which is opposed to the inside of the cartridge body is located in its inside.

In this first stripping process, the first and second shutters are slid by a length which is twice the length to strip the sealing member. Accordingly, if the length to strip the sealing member in the first stripping process is taken as x, the stroke for stripping in the first stripping process is 2x. Furthermore, in the second stripping process, the sealing member is stripped while being folded, so that the length to strip the sealing member and the stroke for stripping are equal to each other. More specifically, if the length of the opening is taken as L, the length to strip the sealing member in the second stripping process is (L−x) and thus, the stroke for stripping is (L−x).

As a result, the stroke for stripping for completely opening the opening is as follows:

$$2x+(L-x)=L+x$$

For example, if the middle position for stripping is set to the center of the opening, x=L/2 and thus, the stroke for stripping is 1.5 L. Thus, the stroke for stripping is short.

Furthermore, the sealing member is so folded that its toner adhering surface is located in its inside, thereby causing no contamination by toner.

Additionally, if the front end of the sealing member is fixed to, for example, a front end of the first shutter, the sealing member is required only a length slightly larger than that of the opening. Consequently, a large part of the sealing member can be prevented from being ineffective.

Moreover, if the second shutter is pulled, the first shutter is slid in synchronism with the second shutter, thereby to make it easy to operate the toner cartridge. Consequently, the load of toner supplying work can be reduced.

The foregoing and other object, features, aspects and advantages of the present invention will become more apparent from the following detailed description of the present invention when taken in conjunction with the accompanying drawings.

BRIEF DESCRIPTION OF THE DRAWINGS

FIG. 4(*b*) is a transverse sectional view showing the toner cartridge;

FIG. 10(*b*) is a transverse sectional view showing the toner cartridge;

FIG. 17(*b*) is a transverse sectional view showing the toner cartridge;

DESCRIPTION OF THE PREFERRED EMBODIMENTS

Embodiments of the present invention will be described in detail with reference to the accompanying drawings.

Figure 1:
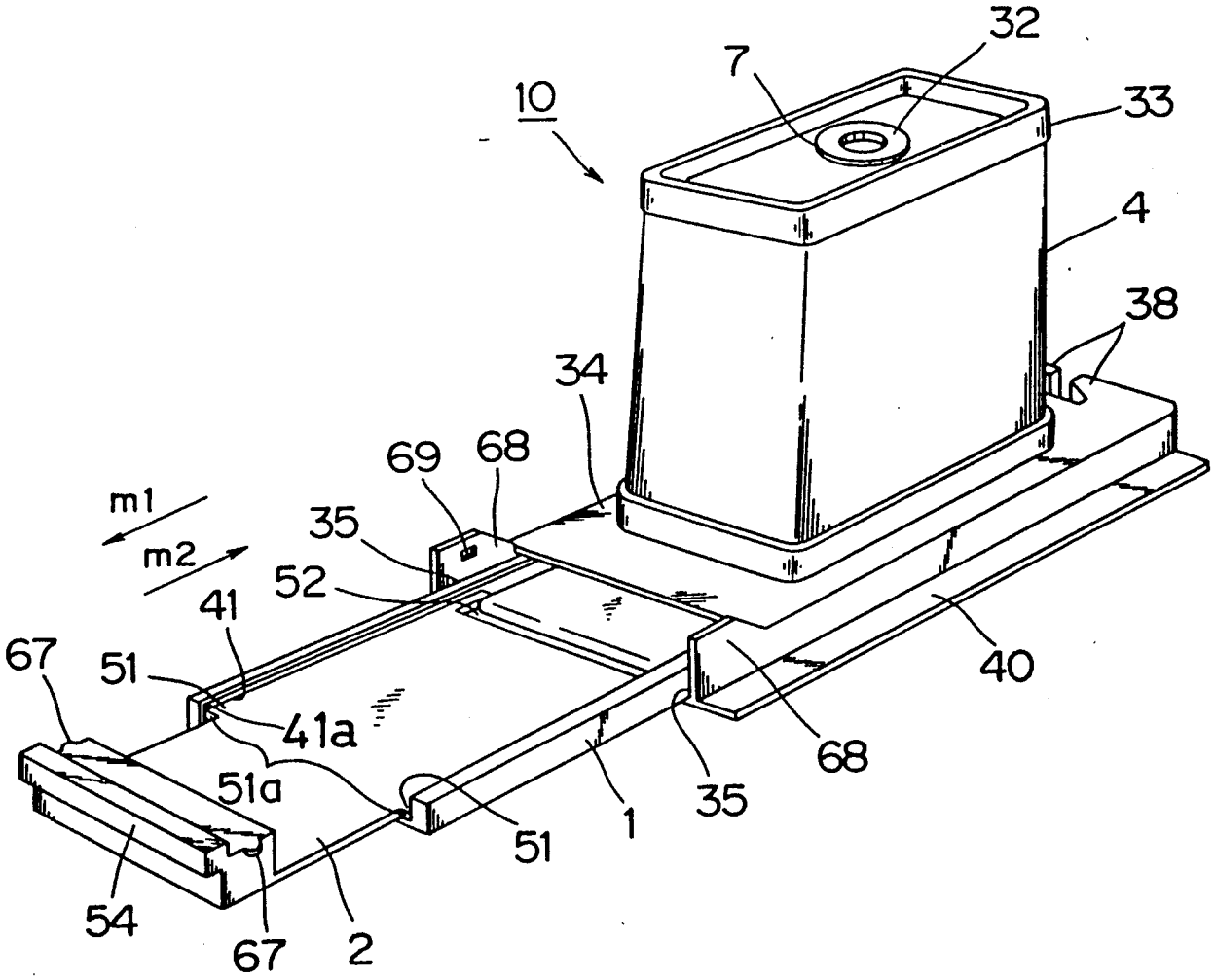
FIG. 1 is a perspective view showing a toner cartridge according to a first embodiment of the present invention.
Figure 2:
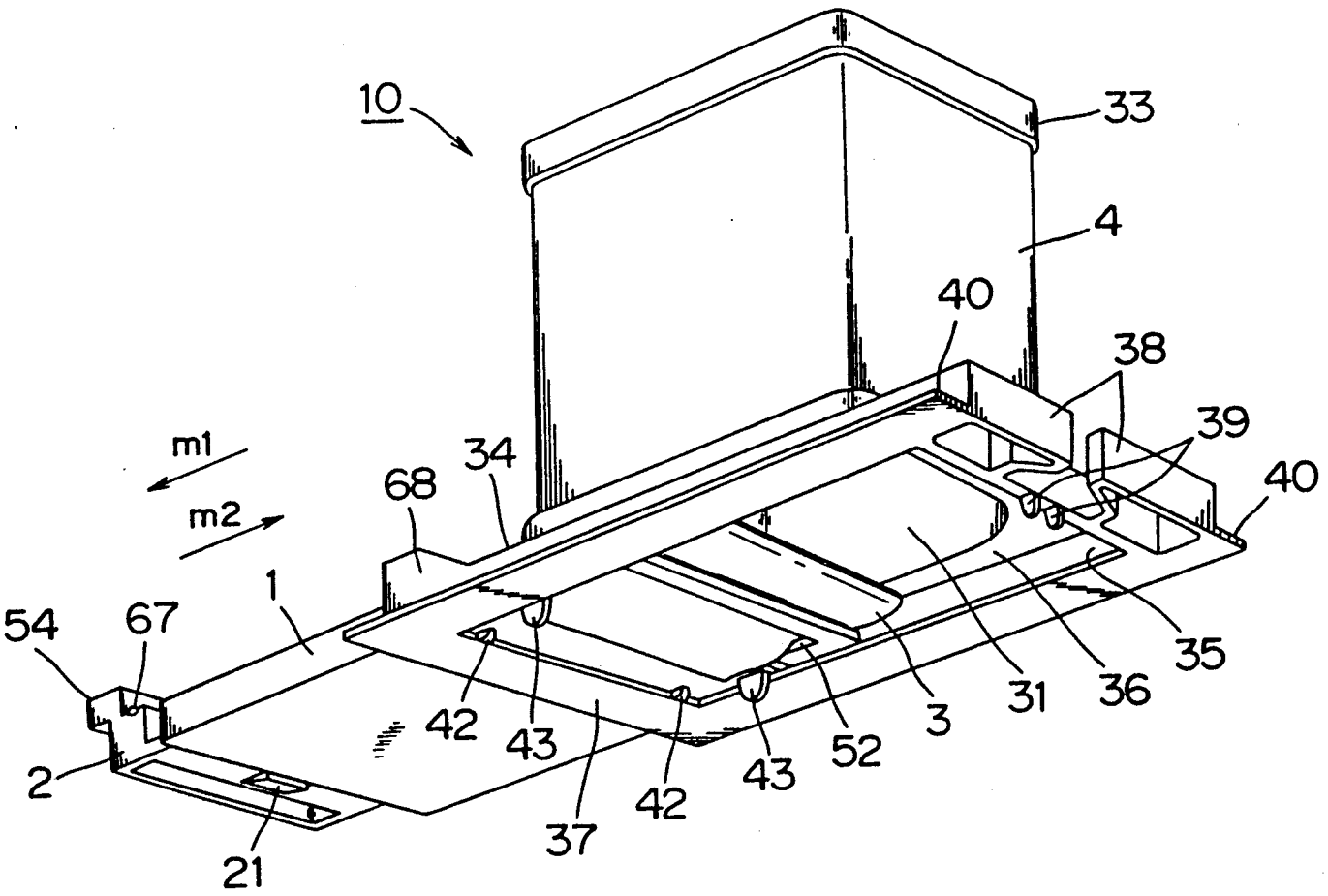
FIG. 2 is a perspective view showing the toner cartridge as viewed from below.

FIGS. 1 and 2 are perspective views showing a toner cartridge 10 according to a first embodiment of the present invention. The toner cartridge 10 comprises a cartridge body 4 formed in a substantially cylindrical shape and capable of containing toner. A cover body 33 is bonded to an opening in an upper part of the cartridge body 4. A toner fill opening 7 for filling the cartridge body 4 with toner is formed in a substantially central part of the cover 33. The toner fill opening 7 is sealed with a cap 32. A shutter mounting body 34 is bonded to a lower part of the cartridge body 4. A first shutter 1 is slidably mounted on the shutter mounting body 34. A second shutter 2 is slidably mounted on the first shutter 1. An opening 31 in the lower part of the cartridge body 4 is sealed with a sealing member 3.

Figure 3:
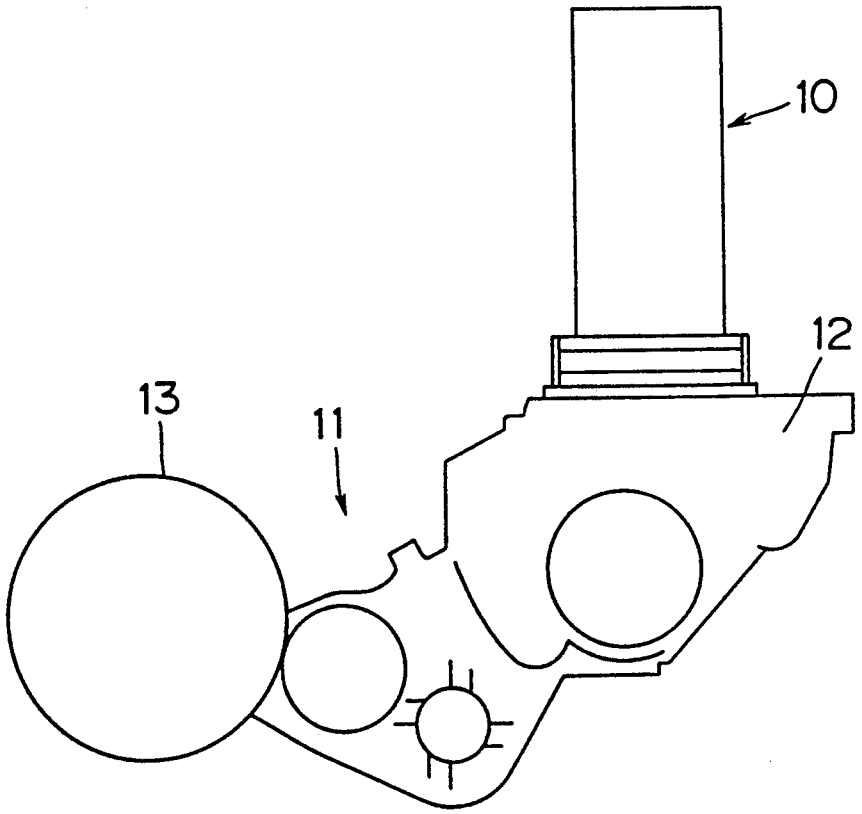
FIG. 3 is a cross sectional view showing in a simplified manner a state where the toner cartridge is used to supply toner to a copying machine.

The toner cartridge 10 is used in, for example, supplying toner to a developing device 11 in a copying machine, as shown in FIG. 3. More specifically, the toner cartridge 10 is set on a toner hopper 12 when there is little toner left in the toner hopper 12 to supply toner in the toner cartridge 10 to the toner hopper 12. In FIG. 3, reference numeral 13 denotes a photosensitive drum in the copying machine.

Figure 4B:
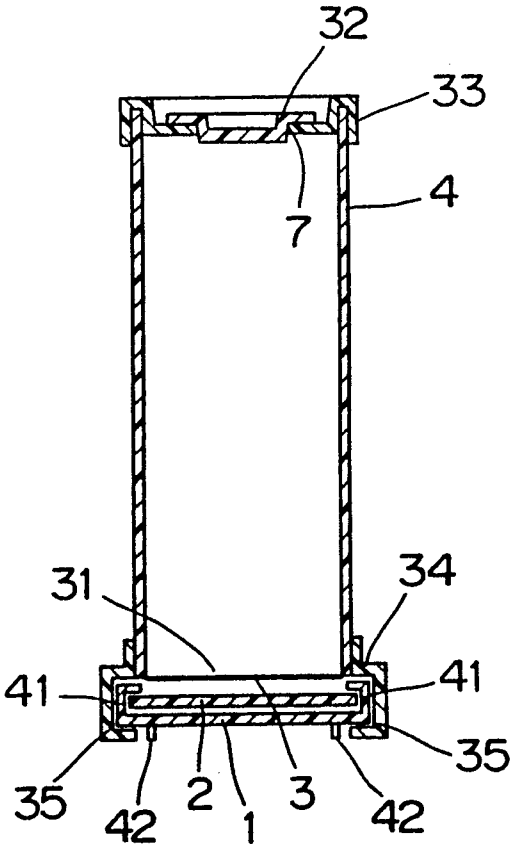
FIG. 4(*a*) is a vertical sectional view showing the toner cartridge.
Figure 4A:
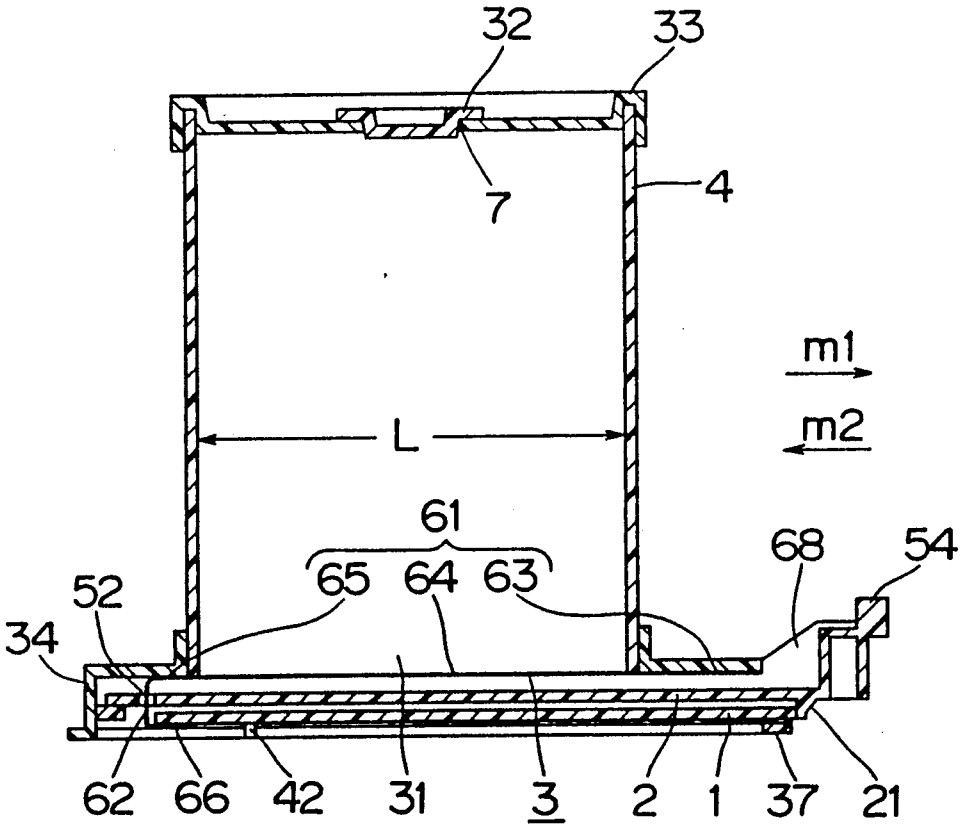

FIG. 4 is a cross sectional view showing the toner cartridge. FIG. 4(*a*) is a vertical sectional view taken in a direction to slide the first and second shutters 1 and 2, and FIG. 4(*b*) is a transverse sectional view crossing the direction to slide the first and second shutters 1 and 2. The shutter mounting body 34 is constructed by forming a resin material in a substantially box shape having a small thickness. The shutter mounting body 34 is formed in a hollow shape, and has a toner discharge opening 36 corresponding to the opening 31 of the cartridge body 4 formed in its central part by penetrating its upper and lower surfaces. In addition, inner surfaces 35 of both side parts of the shutter mounting body 34 are guide surfaces for guiding the first shutter 1 in a stripping direction m1 to strip the sealing member 3 or a containing direction m2 to contain the first and second shutters 1 and 2. In addition, a pair of engaging projections 68 is provided in both the side parts in one end in the stripping direction m1 of the shutter mounting body 34, as shown in FIG. 1, and recesses 69 are respectively formed in the engaging projections 68. When the second shutter 2 is contained in the shutter mounting body 34, engaging projections 67 of the second shutter 2 are respectively engaged with the recesses 69, to regulate the movement of the shutters 1 and 2.

Furthermore, a bridge part 37 for preventing the first shutter 1 from slipping off as well as reinforcing the shutter mounting body 34 is provided on a lower surface of the shutter mounting body 34. In addition, there are provided an engaging part 38 serving as engaging means in mounting the toner cartridge 10 on the toner hopper 12, a pair of projected parts 39 serving as lock releasing means of a hopper cover (not shown), and a pair of guide tongue members 40 guided to a guiding part (not shown) of the toner hopper 12.

The first shutter 1 is constructed by forming a resin material in a substantially plate shape, and has a bottom part and a pair of side parts. Inner surfaces of both the side parts are formed in a substantially channel like shape in cross section, and functions as guide grooves 41 for guiding the second shutter 2. In addition, a pair of slip preventing projections 42 is formed on the lower surface in a front end of the first shutter 1. The slip preventing projections 42 are abutted on the bridge part 37 of the shutter mounting body 34 for preventing the first shutter 1 from slipping off. Further, a pair of projections 43 is formed on the lower surface in the front end of the first shutter 1. When the cartridge 10 is mounted on the toner hopper 12, toner flattening means (not shown) provided on the side of the toner hopper 12 is engaged with the projections 43. Consequently, when the first shutter 1 is displaced, the height of a toner layer in the toner hopper 12 can be flattened.

The second shutter 2 is constructed by forming a resin material in a substantially plate shape. Guide projections 51 are formed over a predetermined length in both side parts of the second shutter 2. The guide projections 51 are respectively engaged with the guide grooves 41 in both the side parts of the first shutter 1. Consequently, the second shutter 2 is slidable with respect to the first shutter 1. One ends 51*a* of the guide projections 51 are respectively abutted on inner end faces 41*a* on the downstream side in the stripping direction m1 of the guide grooves 41 of the first shutter 1, thereby to regulate the movement of the second shutter 2. Accordingly, the second shutter 2 prevents from slipping off the cartridge body 4.

A slit-shaped seal traction opening 52 through which the sealing member 3 is to be inserted is formed in a front end of the second shutter 2. In addition, a handle 54 on which a worker put his finger to perform a sliding operation is provided in a rear end of the second shutter 2. The engaging projections 67 respectively engaged with the recesses 69 of the engaging projections 68 are formed in both side parts in the vicinity of the handle 54. The engaging projections 67 are respectively engaged with the recesses 69, so that the second shutter 2 is engaged with the shutter mounting body 34. A pressure projected part 21 abutted on a rear end face of the first shutter 1 is provided on a lower surface in the rear end of the second shutter 2.

The sealing member 3 is formed in a film shape. The sealing member 3 comprises a sealing part 61 for sealing the opening 31 of the cartridge body 4 and a non-sealing part 62 which is extended part connecting with the sealing part 61. The non-sealing part 62 is folded along the sealing part 61. More specifically, one end 63 in the stripping direction m1 of the sealing part 61 adheres to an inner surface of the shutter mounting body 34. An intermediate part 64 connecting with the one end 63 is strippably bonded to the opening 31 of the cartridge body 4, to seal the opening 31. The other end 65 connecting with the intermediate part 64 is strippably bonded to a part leading to the inner surface of the shutter mounting body 34. The non-sealing part 62 connects with the other end 65 of the sealing part 61, and the other end 66 adheres to the lower surface in the front end of the front shutter 1 through the seal traction opening 52 of the second shutter 2.

In assembling the toner cartridge 10, toner is previously contained in the cartridge body 4. Thereafter, the sealing part 61 of the sealing member 3 is bonded to the cartridge body 4 to seal the opening 31 of the cartridge body 4. In this state, the second shutter 2 having the first shutter 1 previously mounted thereon is slid in the containing direction m2 from the rear of the shutter mounting body 34, to be mounted on the inside of the shutter mounting body 34. Subsequently, the other end 66 of the non-sealing part 62 of the sealing member 3 is inserted through the seal traction opening 52 of the second shutter 2, and the other end 66 adheres to the front end of the first shutter 1. In addition, the second shutter 2, along with the first shutter 1, is contained in the shutter mounting body 34, and the second shutter 2 is engaged with the cartridge body 4. In the above described manner, the toner cartridge 10 has been assembled.

Figure 5:
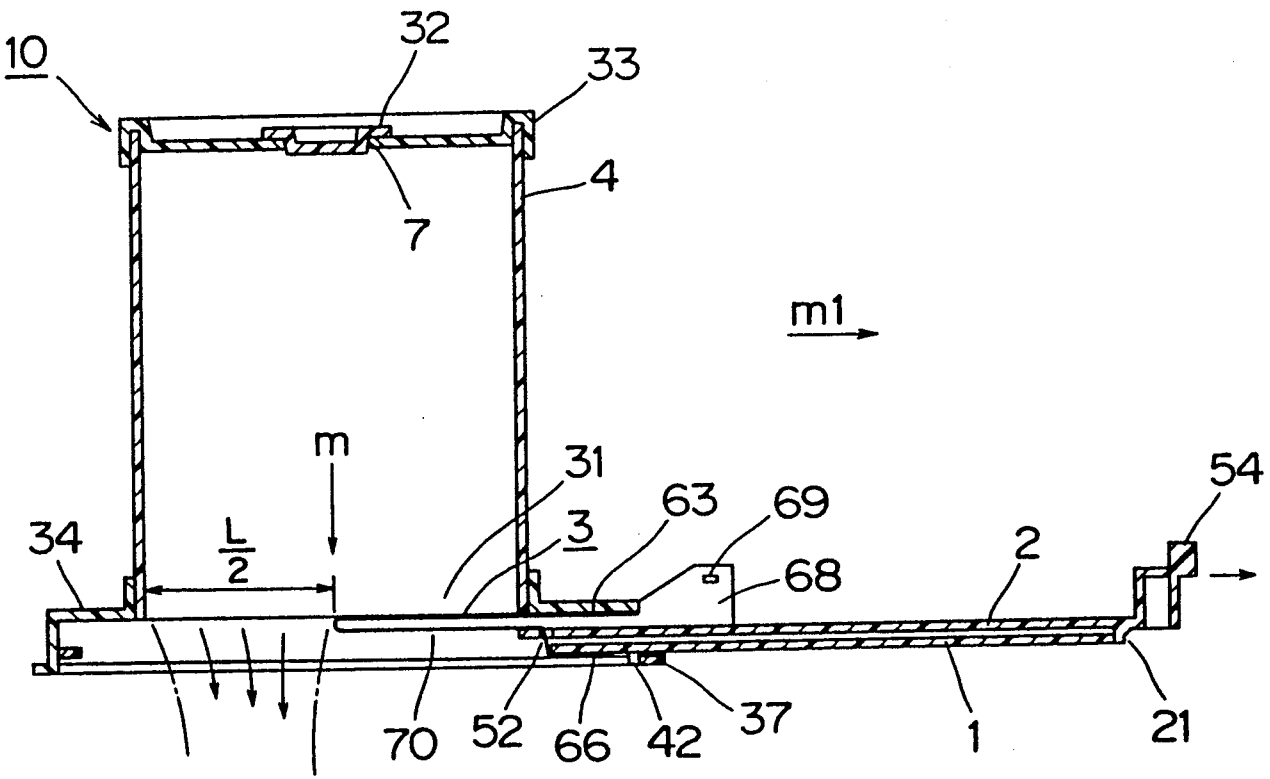
FIG. 5 is a cross sectional view showing the function of the toner cartridge at the time of stripping a sealing member.
Figure 6:
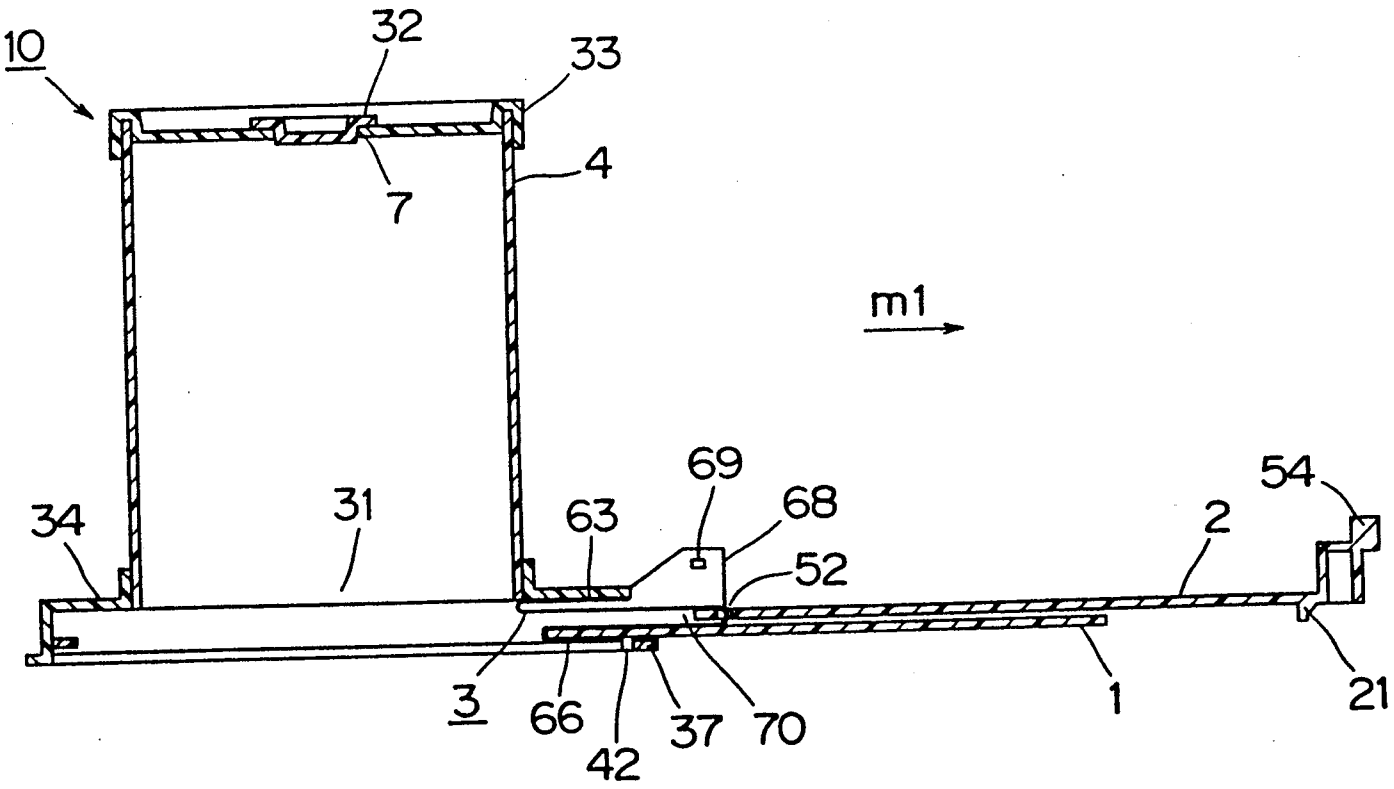
FIG. 6 is a cross sectional view showing the function of the toner cartridge at the time of stripping a sealing member.
Figure 7:
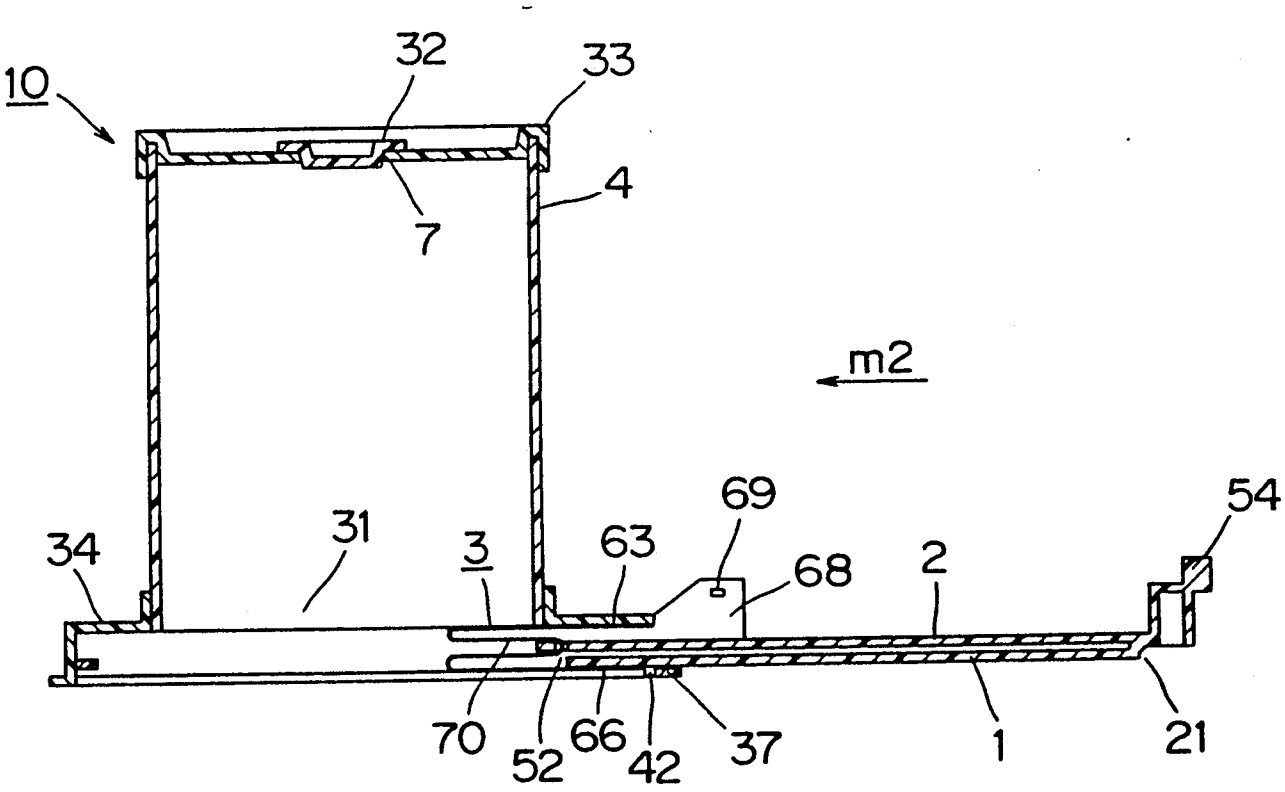
FIG. 7 is a cross sectional view showing the function of the toner cartridge at the time of containing a shutter.

Description is now made of the function of the toner cartridge 10 of the above described construction according to the present embodiment at the time of stripping with reference to FIGS. 5, 6 and 7.

In the toner cartridge 10 according to the present embodiment, the process of stripping the sealing member 3 is classified into two processes depending on where a position for stripping exists. More specifically, in the first stripping process, the position for stripping is in the range from a position where stripping is started to a middle position for stripping m which corresponds to the middle of the opening 31 in the stripping direction m1. On the other hand, in the second stripping process, the position for stripping is in the range from the middle position m for stripping to a position where stripping is completed.

Description is now made of the first stripping process. The first stripping process is achieved by towing the first shutter 1 by the seal traction opening 52 of the second shutter 2 when a worker takes the holder 54 of the second shutter 2 to pull the second shutter 2 in the stripping direction m1. More specifically, the front end of the sealing member 3 adhering to the lower surface of the first shutter 1 is pulled in the stripping direction m1, so that the sealing member 3 is gradually stripped in the stripping direction m1 from the position where stripping is started. As shown in FIG. 5, the movement of the first shutter 1 in the stripping direction m1 is regulated by abutting the slip preventing projections 42 on the bridge part 37 of the shutter mounting body 34. Consequently, the first shutter 1 is slid in the stripping direction m1 by a length L to a position where the opening 31 is completely opened (the length is equal to the length of the opening 31 in the stripping direction m1). As a result, the sealing member 3 is stripped by a length L/2 which is one-half the length L of the opening 31, as shown in FIG. 5. Toner is discharged downward from the opening 31 opened as the sealing member 3 is stripped.

Description is now made of the second stripping process. The second stripping process is achieved by further pulling the second shutter 2 in the stripping direction m1 from the state shown in FIG. 5. More specifically, the movement of the first shutter 1 is regulated in the state shown in FIG. 5, so that only the second shutter 2 is slid. The sliding movement is regulated in a position where the end faces 51*a* of the guide projections 51 shown in FIG. 1 are respectively abutted on end faces on the downstream side in the stripping direction m1 of the guide grooves 41 in the side parts of the first shutter 1. This state is shown in FIG. 6. Consequently, the second shutter 2 is moved over a length L/2 which is one-half the length L of the opening 31. In the second stripping process, the stroke length of the second shutter 2 is equal to the length to strip the sealing member 3, so that the opening 31 is completely opened by the sliding movement of the second shutter over the length L/2. At this time, the sealing member 3 stripped is folded in a state where its toner adhering surface 70 is located in its inside, as shown in FIG. 6, thereby to make it possible to reliably prevent contamination by toner.

The stroke for stripping in the toner cartridge 10 according to the present embodiment is 1.5 times the length L of the opening 31 in the stripping direction m1. More specifically, the stroke for stripping in the above described first stripping process is L, as can be seen from FIG. 5. On the other hand, the stroke for stripping in the above described second stripping process is 0.5 L, as can be seen from FIG. 6. Consequently, the entire stroke for stripping is 1.5 L which is 1.5 times the length of the opening 31. The stroke for stripping is thus relatively short.

Meanwhile, an operation in the procedure opposite to that at the time of stripping is performed after the supply of toner to the toner hopper 12 is completed. More specifically, as shown in FIG. 7, when the second shutter 2 is pushed in the containing direction m2, the rear end face of the first shutter 1 is abutted on the pressure projected part 21 of the second shutter 2. Consequently, when the second shutter 2 is further pushed, the first shutter 1 and the second shutter 2 are integrally slid, to be contained in the shutter mounting body 34. At this time, the opening 31 is sealed with the sealing member 3 as before. In addition, the first shutter 1 and the second shutter 2 also cover the opening 31 tight as before. In a state where the first shutter 1 and the second shutter 2 are contained in the shutter mounting body 34, the engaging projections 67 of the second shutter 2 are respectively engaged with the recesses 69 of the engaging projections 68 of the shutter mounting body 34. Even when the cartridge 10 is carried, therefore, the shutters 1 and 2 do not slip off, so that the opening 31 is not exposed. As a result, toner is not scattered.

In the toner cartridge 10 according to the present embodiment, the stroke for stripping is short, and there is no contamination by toner. Furthermore, as can be seen from FIG. 4, the length of the sealing member 3 is slightly larger than the length L of the opening 31, thereby eliminating the need for a sealing member having a length which is twice that of the opening as in the conventional example. Consequently, it is possible to prevent a large part of the sealing member from being ineffective. In addition, the first shutter 1 is slidable with respect to the second shutter 2, thereby to make it possible to make the cartridge 10 compact.

Meanwhile, the present embodiment may be modified to eliminate the slip preventing projections 42 of the first shutter 1 and eliminate the pressure projected part 21 of the second shutter 2. Further, the sealing member 3 may be towed by attaching a pulley or the like to a position of the seal traction opening 52 of the second shutter 2 and winding the sealing member 3 around the pulley instead of towing the sealing member 3 by the seal traction opening 52.

Furthermore, although in the above described embodiment, description was made of a case where the first stripping process and the second stripping process are carried out in that order, it is needless to say that the first stripping process and the second stripping process may proceed simultaneously.

Figure 8:
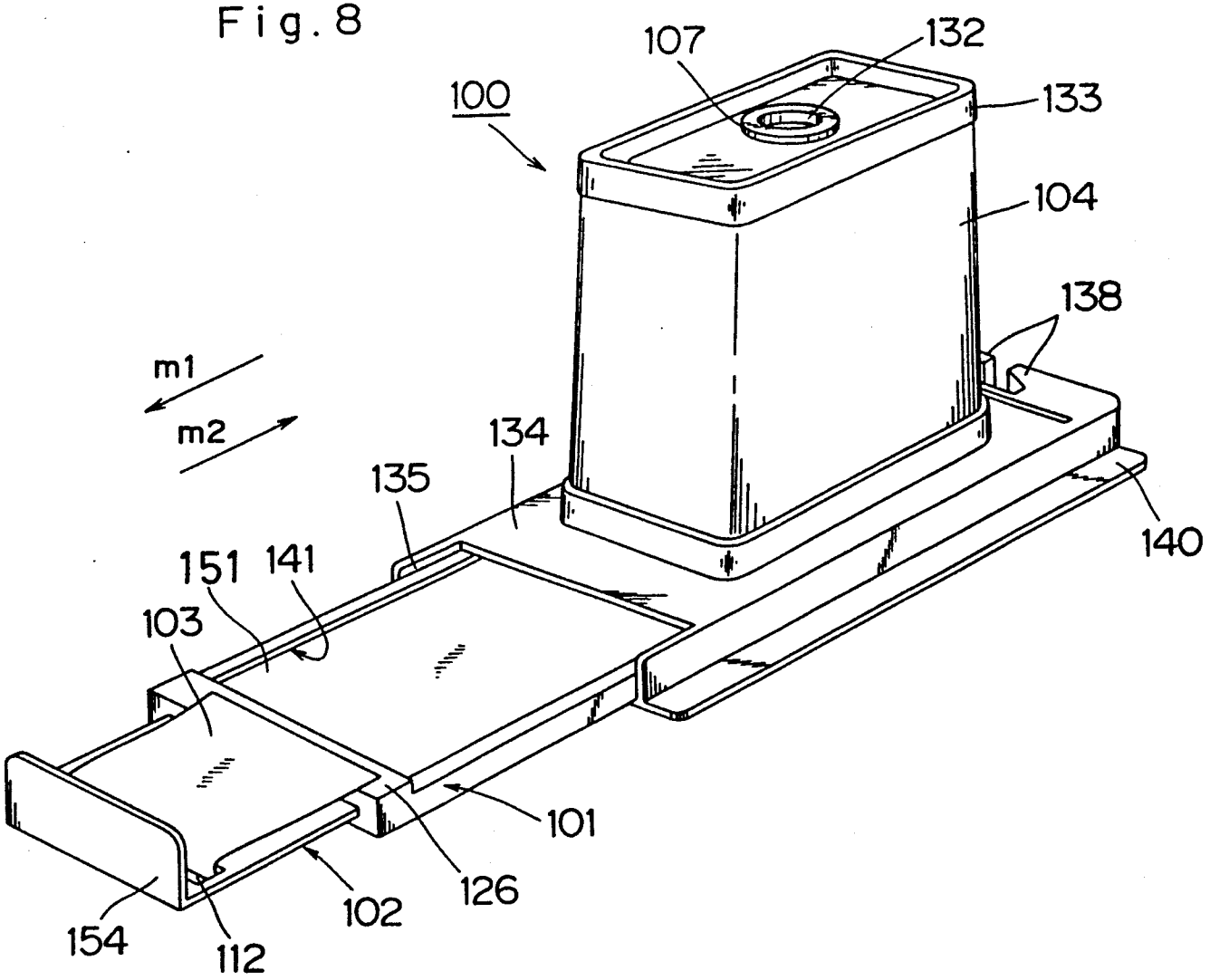
FIG. 8 is a perspective view showing a toner cartridge according to a second embodiment of the present invention.
Figure 9:
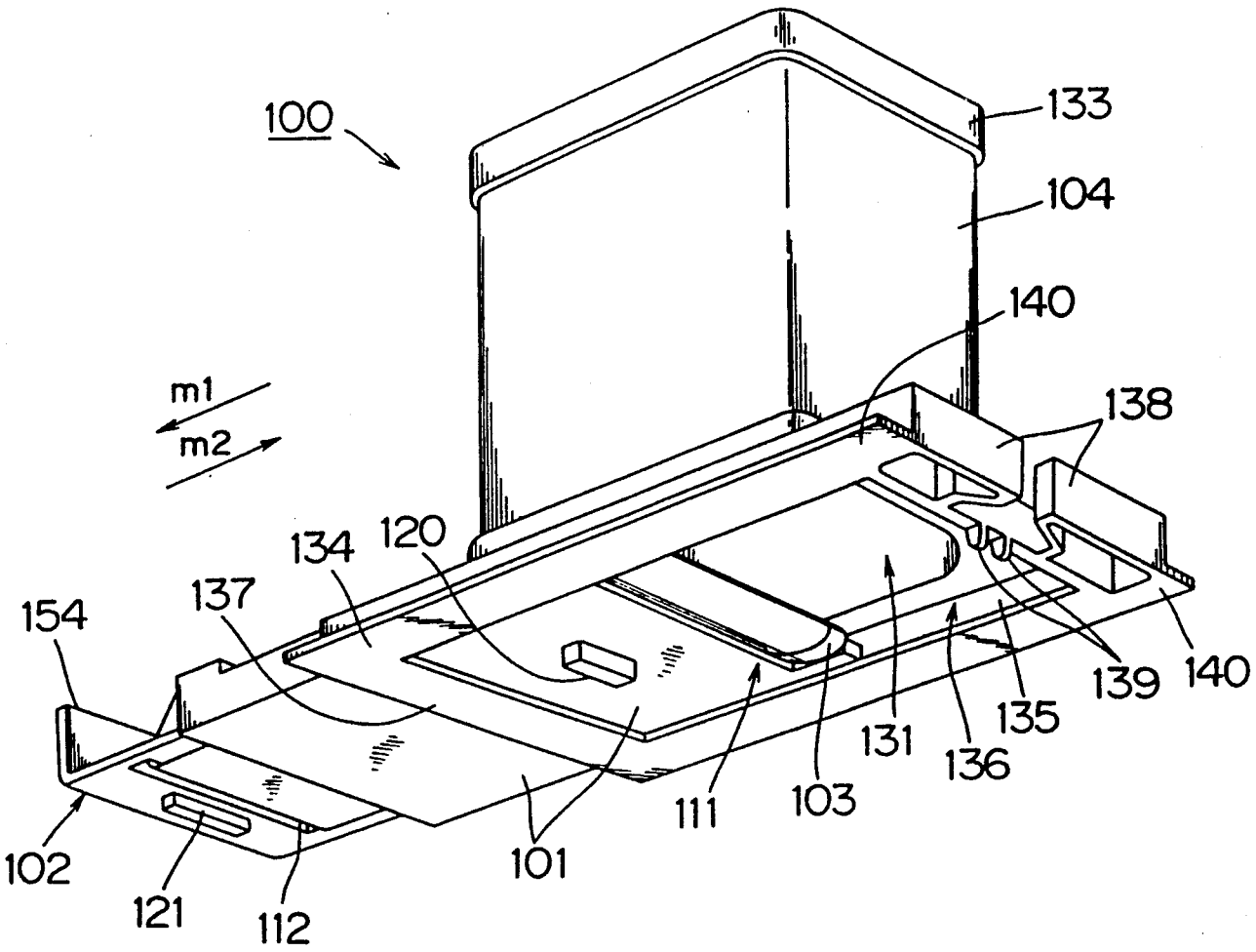
FIG. 9 is a perspective view showing the toner cartridge as viewed from below.
Figure 10B:
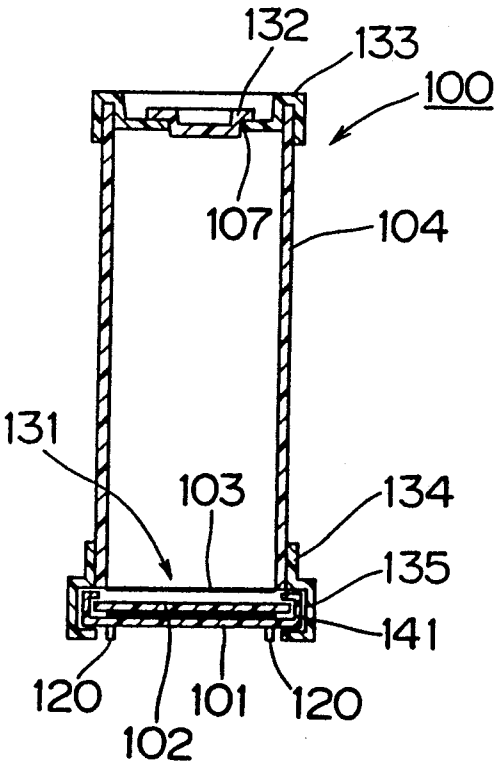
FIG. 10(*a*) is a vertical sectional view showing the toner cartridge.
Figure 10A:
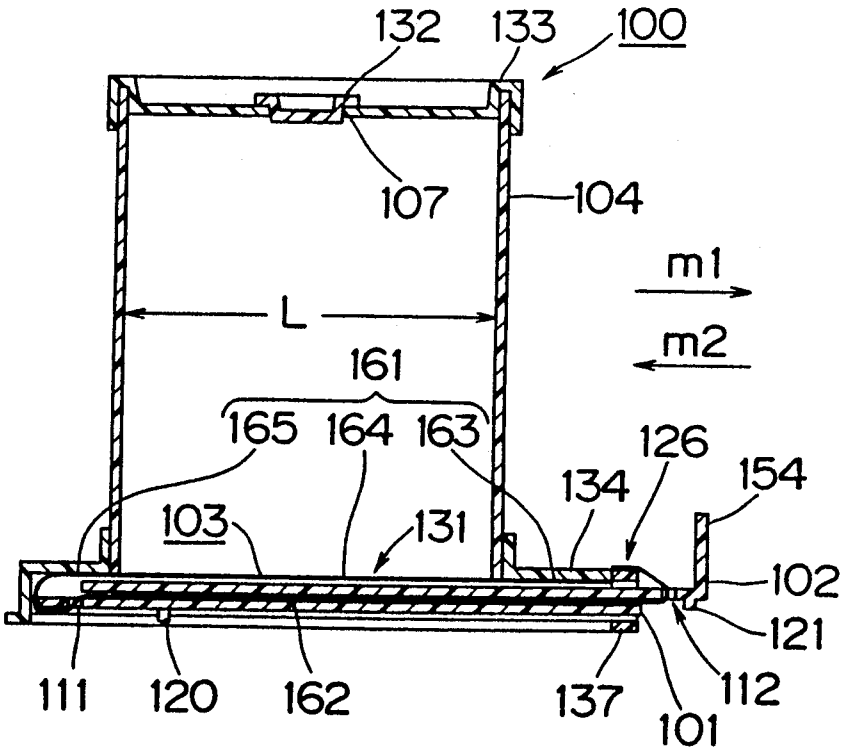

FIGS. 8 and 9 are perspective views showing the construction of a toner cartridge 100 according to a second embodiment of the present invention. In addition, FIG. 10 is a cross sectional view showing the toner cartridge 100, where FIG. 10 (*a*) is a vertical sectional view taken in a stripping direction ml, and FIG. 10 (*b*) is a transverse sectional view crossing the stripping direction ml. The toner cartridge 100 is mainly constituted by a cartridge body 104, a cover body 133, a shutter mounting body 134, a first shutter 101, a second shutter 102, and a sealing member 103.

The cartridge body 104 is formed in a substantially cylindrical shape, and contains toner. The cover body 133 is bonded to an opening in an upper part of the cartridge body 104. A toner fill opening 107 for filling the cartridge body 104 with toner is formed in a substantially central part of the cover body 133. The toner fill opening 107 is sealed with a cap 132. The shutter mounting body 134 is bonded to a lower part of the cartridge body 104. The first shutter 101 is slidably mounted on the shutter mounting body 134. The second shutter 102 is slidably mounted on the first shutter 101. An opening 131 in the lower part of the cartridge body 104 is sealed with the sealing member 103.

The shutter mounting body 134 is constructed by forming a resin material in a box shape. The shutter mounting body 134 is so formed in a hollow shape that the first shutter 101 can be contained and slid. In addition, the shutter mounting body 134 has a toner discharge opening 136 corresponding to the opening 131 of the cartridge body 104 formed in its central part by penetrating its upper and lower surfaces. Inner side surfaces 135 on both sides of the shutter mounting body 134 are guide surfaces for guiding the movement of the first shutter 101. In addition, a bridge part 137 for preventing the first shutter 101 from slipping off at the time of sliding as well as reinforcing the shutter mounting body 134 is provided on a lower surface of the shutter mounting body 134.

The shutter mounting body 134 is provided with an engaging part 138 serving as engaging means when the toner cartridge 100 is mounted on a toner hopper (not shown), a pair of projected parts 139 serving as lock releasing means of a hopper cover (not shown), and a pair of guide tongue members 140 guided to a guiding part of the toner hopper (not shown).

The first shutter 101 is constructed by forming a resin material in a plate shape, and has a bottom part and both side parts formed integrally with the bottom part. Inner surfaces of the side parts are formed in a substantially channel like shape in cross section, and functions as a guide groove 141 for guiding the movement of the second shutter 102. A first slit 111 through which a part of the sealing member 103 is to be inserted is formed in a front end of the first shutter 101. In addition, a slip preventing projection 120 abutted on the bridge part 137 of the shutter mounting body 134 for inhibiting the movement of the first shutter 101 is formed on a lower surface in a front end of the first shutter 101.

The second shutter 102 is constructed by forming a resin material in a plate shape. A second slit 112 through which a part of the sealing member 103 is to be inserted is formed in a rear end of the second shutter 102. The slit 112 functions as a traction port for pulling the sealing member 103 in the stripping direction ml. In addition, a handle 154 on which a worker put his finger to perform a sliding operation is provided in the rear end of the second shutter 102. A projection 121 is formed on a lower surface in the rear end of the second shutter 102. The projection 121 is abutted on the first shutter 101 when the second shutter 102 is slid in the containing direction m2. Consequently, the first shutter 101 and the second shutter 102 can be simultaneously contained in the cartridge body 104 compactly by sliding the second shutter 102 in the containing direction m2.

The guide projections 151 are respectively engaged with the guide grooves 141 in both the side parts of the second shutter 102. One ends of the guide projections 151 are respectively abutted on inner end faces of the guide grooves 141, thereby to regulate the movement of the second shutter 102. The second shutter 102 thus prevents from slipping off the cartridge body 104.

The sealing member 103 seals the entire surface of the opening 131 in the lower part of the cartridge body 104 from one end of the opening 131. The sealing member 103 is formed in a film shape, and has a sealing part 161 for sealing the opening 131 and a non-sealing part 162 which is an extended part connecting with the sealing part 161. The non-sealing part 162 is folded along the sealing part 161. More specifically, one end 163 in the stripping direction ml of the sealing part 161 adheres to an inner surface of the shutter mounting body 134. An intermediate part 164 connecting with the one end 163 is strippably bonded to a peripheral edge part of the opening 131 of the cartridge body 104, to seal the opening 131. The other end 165 connecting with the intermediate part 164 is strippably bonded to a part leading to the inner surface of the shutter mounting body 134. The non-sealing part 162 connects with the other end 165 of the sealing part 161 and is folded on the side of the other end 165. The non-sealing part 162 is inserted through the first slit 111 from the lower surface of the first shutter 101 toward the second shutter 102 thereof, passes between the first shutter 101 and the second shutter 102 and then, is inserted through the second slit 112, to be fixed to a fixing part 126 provided in an end of the first shutter 101.

Figure 11:
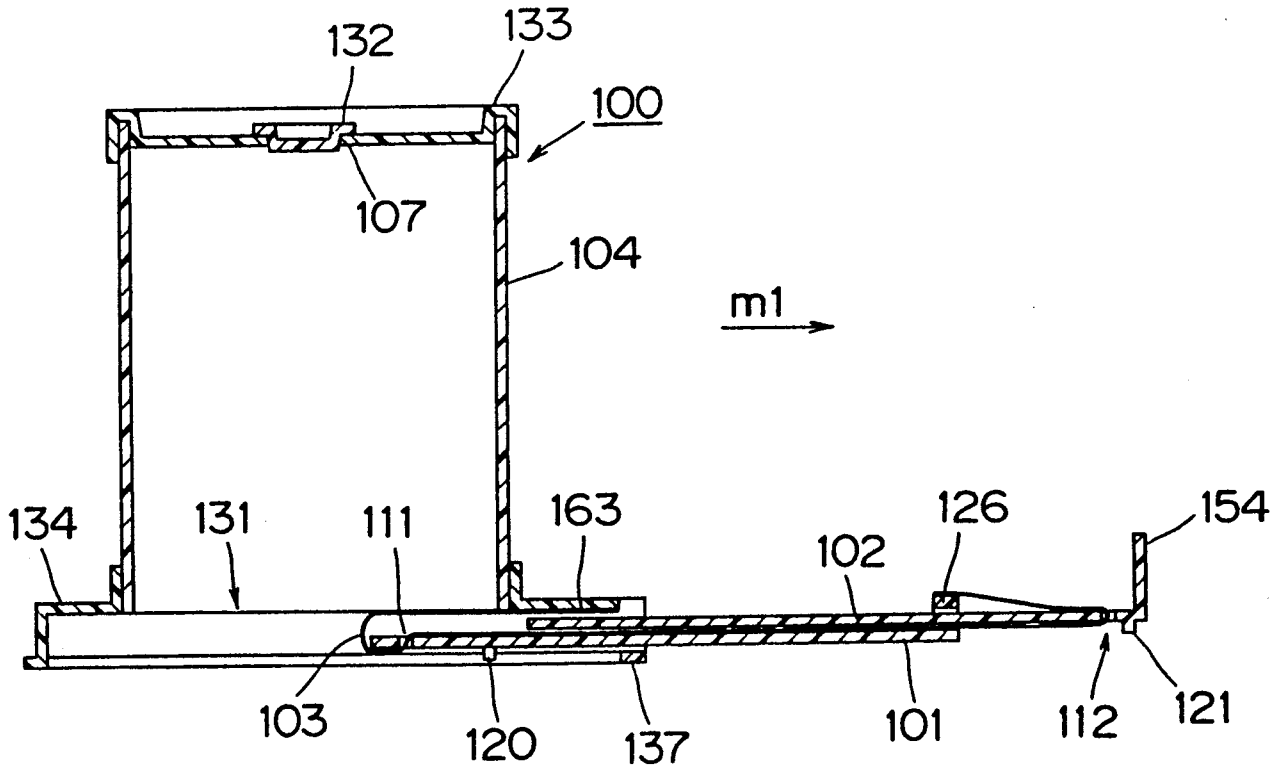
FIG. 11 is a cross sectional view showing the function of the toner cartridge at the time of stripping a sealing member.
Figure 12:
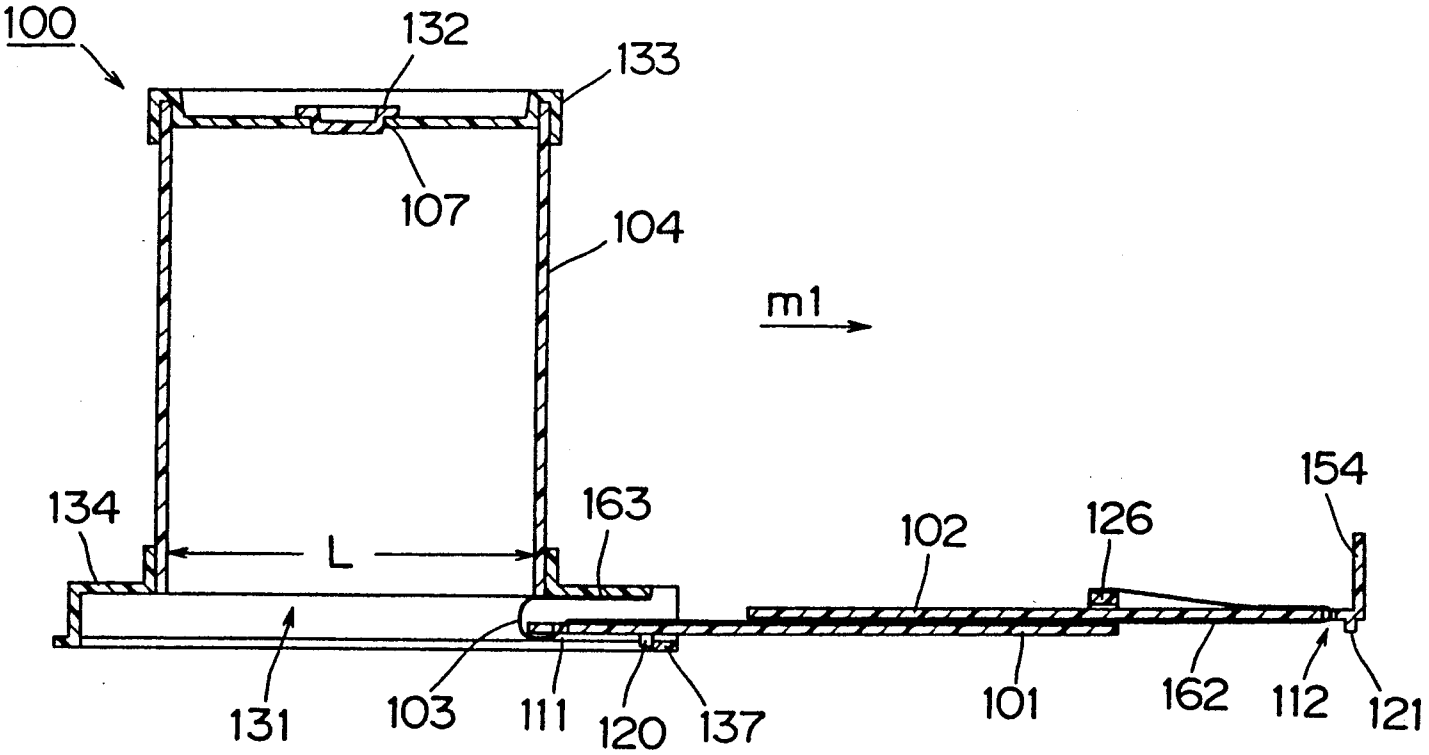
FIG. 12 is a cross sectional view showing the function of the toner cartridge at the time of stripping a sealing member.

Referring now to FIGS. 10, 11 and 12, description is made of the function of the toner cartridge 100 of the above described construction according to the present embodiment at the time of stripping.

FIG. 10 shows a state where the sealing member 103 is not stripped. In this state, the sealing member 103 covers the entire surface of the opening 131. Although in FIG. 10, the projection 121 is not abutted on the first shutter 101, the first shutter 101 and the second shutter 102 can be also contained in the shutter mounting body 134 with the projection 121 being abutted on the first shutter 101.

The sealing member 103 is stripped by a worker taking the handle 154 of the second shutter 102 to pull the same in the stripping direction m1. If the second shutter 102 is slid, the sealing member 103 receives a traction force by the second slit 112. As a result, the sealing member 103 moves through the second slit 112 and the first slit 111, as shown in FIG. 11. Since the sealing member 103 is fixed to the fixing part 126 of the first shutter 101, however, the first shutter 101 is slid in the stripping direction m1 later than the second shutter 102 on the principle of pulleys.

As shown in FIG. 12, the movement of the first shutter 101 in the stripping direction m1 is regulated by abutting the projection 120 on the bridge part 137 of the shutter mounting body 134. That is, the first shutter 101, along with the second shutter 102, can be slid by a length equal to the length L of the opening 131.

The sealing member 103 is towed by the second slit 112 as the first shutter 101 and the second shutter 102 are thus slid. As a result, the sealing part 161 of the sealing member 103 is gradually stripped from a position where stripping is started of the opening 131. The sealing member 103 is stripped to open the opening 131, so that toner in the cartridge body 104 is discharged downward.

Figure 13A:
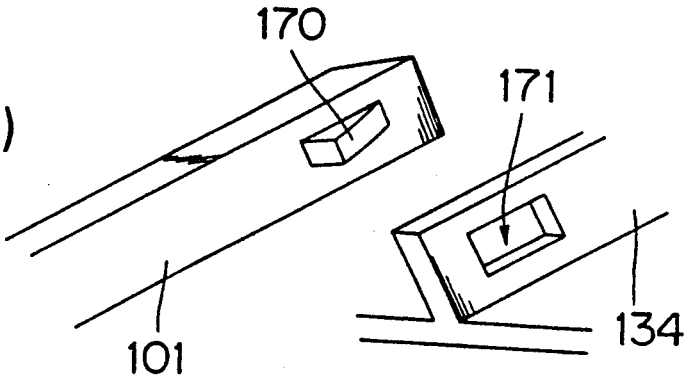
FIGS. 13(*a*) (*b*) is a perspective view showing examples of construction for preventing a first shutter from slipping off.
Figure 13B:
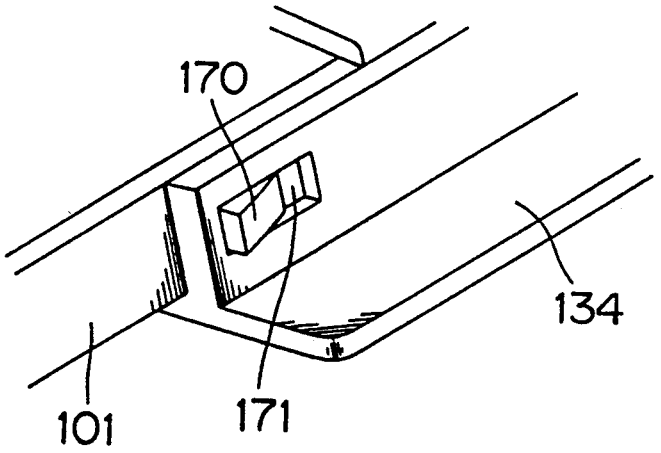

Meanwhile, a projection 170 may be provided on an outer side surface of the first shutter 101 in place of the projection 120, and a hole 171 engaged with the projection 170 may be formed on a side surface of the shutter mounting body 134 in place of the bridge part 137, as shown in FIG. 13 (*a*). FIG. 13 (*b*) shows a state where the projection 170 and the hole 171 are engaged with each other.

FIG. 11 shows a state where the sealing member 103 is stripped by a length which is approximately one-half the length L, and FIG. 12 shows a state where the opening 131 is completely opened. As can be seen from FIGS. 11 and 12, the strokes for strippings in the first shutter 101 and the second shutter 102 differ from each other. More specifically, the first shutter 101 is moved by L, while the second shutter 102 is moved by 3 L/2 until the sealing member 103 is stripped to a position where stripping is terminated. Consequently, the stroke for stripping required for the worker is 1.5 L.

The second shutter 102 is thus pulled out by a length which is 1.5 times the length L in the stripping direction ml of the opening 131, thereby to make it possible to completely open the opening 131.

For example, the stroke for stripping in a case where the sealing member 103 is pulled in the stripping direction ml without using the first and second shutters 101 and 102 is 2 L. If f is taken as a pulling force required for stripping at this time, a pulling force of 1.5 f is required to strip the sealing member in the present embodiment on the principle of pulleys. Meanwhile, in the prior art disclosed in Japanese Patent Laid-Open Gazette No. 280781/1989 and the prior art disclosed in Japanese Patent Publication No. 60142/1989, the stroke for stripping is L, and a force required for stripping is 2 f.

Thus, in the toner cartridge 100 according to the present embodiment, the stroke for stripping is short and a force required for stripping is small. Consequently, a space required to supply toner to the toner hopper can be made relatively small, and toner supplying work can be easily performed. In addition, a part to which toner adheres of the sealing member 103 when the first and second shutters 101 and 102 are opened is contained with it being interposed between the first shutter 101 and the second shutter 102. Consequently, the toner can be prevented from being dropped from the toner cartridge 100.

Meanwhile, in a state where the opening 131 is completely opened as shown in FIG. 12, a front end in the stripping direction ml of the toner adhering surface of the sealing member 103 is not shielded by the first shutter 101 but exposed. Since the exposed end is the above described non-sealing part 162, however, no toner adheres thereto. Consequently, there occurs no problem of contamination by toner.

Additionally, in the present embodiment, the above described effects can be exhibited while preventing the size of the toner cartridge 100 from being made larger in a state where the shutters are contained by the above described characteristic arrangement of the sealing member 103 and the like.

Furthermore, in the present embodiment, the shutters can be pulled smoothly by applying a constant force from the start of stripping to the termination of stripping, so that the operation is felt natural.

Figure 14:
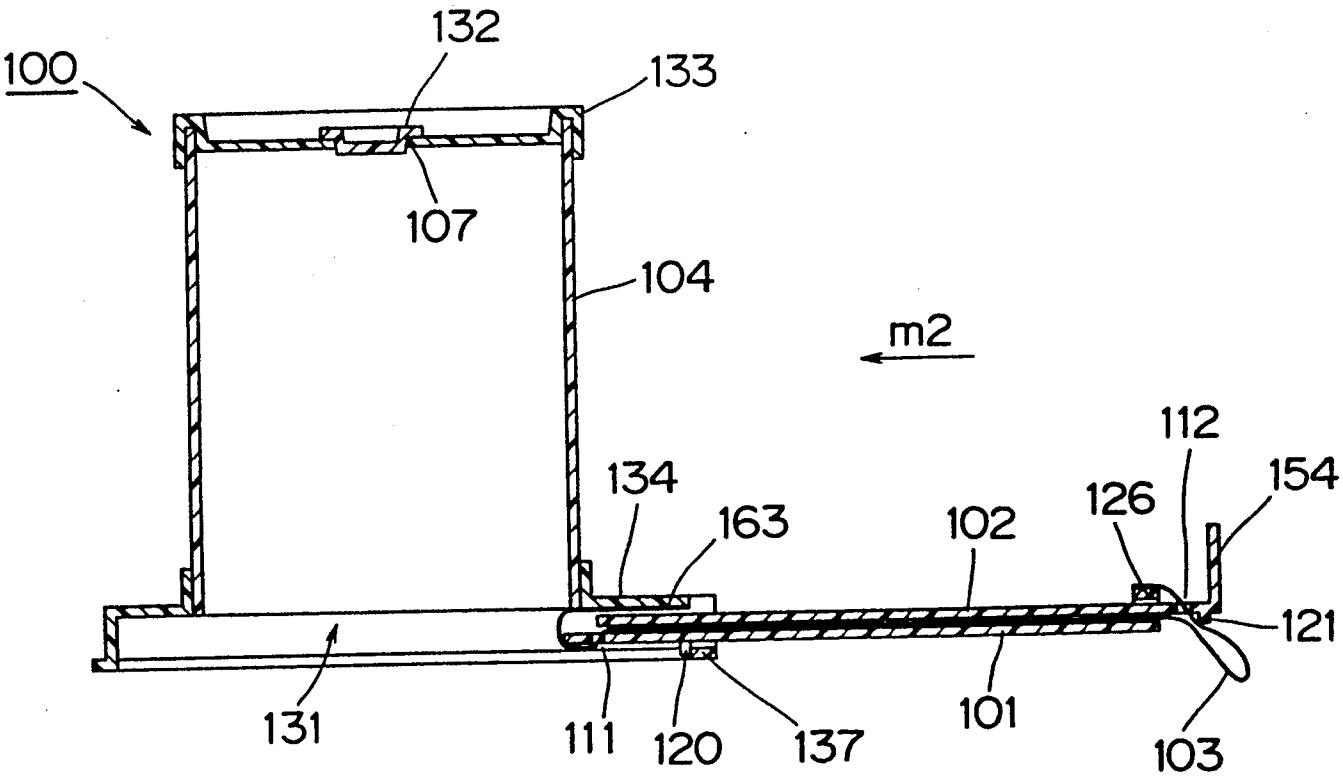
FIG. 14 is a cross sectional view showing the function of the toner cartridge at the time of containing a shutter.

After the supply of toner is completed, the second shutter 102 is pushed into the shutter mounting body 134, as shown in FIG. 14, contrary to the time of stripping the sealing member 103. Consequently, both the first and second shutters 101 and 102 are contained in the cartridge body 104, to be returned to the state shown in FIG. 10. More specifically, when the second shutter 102 is pushed, the projection 121 is abutted on the end of the first shutter 101. Consequently, when the second shutter 102 is further pushed, the first shutter 101, along with the second shutter 102, is displaced. The two shutters 101 and 102 can be thus contained in the cartridge body 104 reliably and compactly. Meanwhile, the projection 121 need not be provided. In this case, the sealing member 103 is pushed by the front end of the second shutter 102, to be returned to the state shown in FIG. 10.

Figure 15:
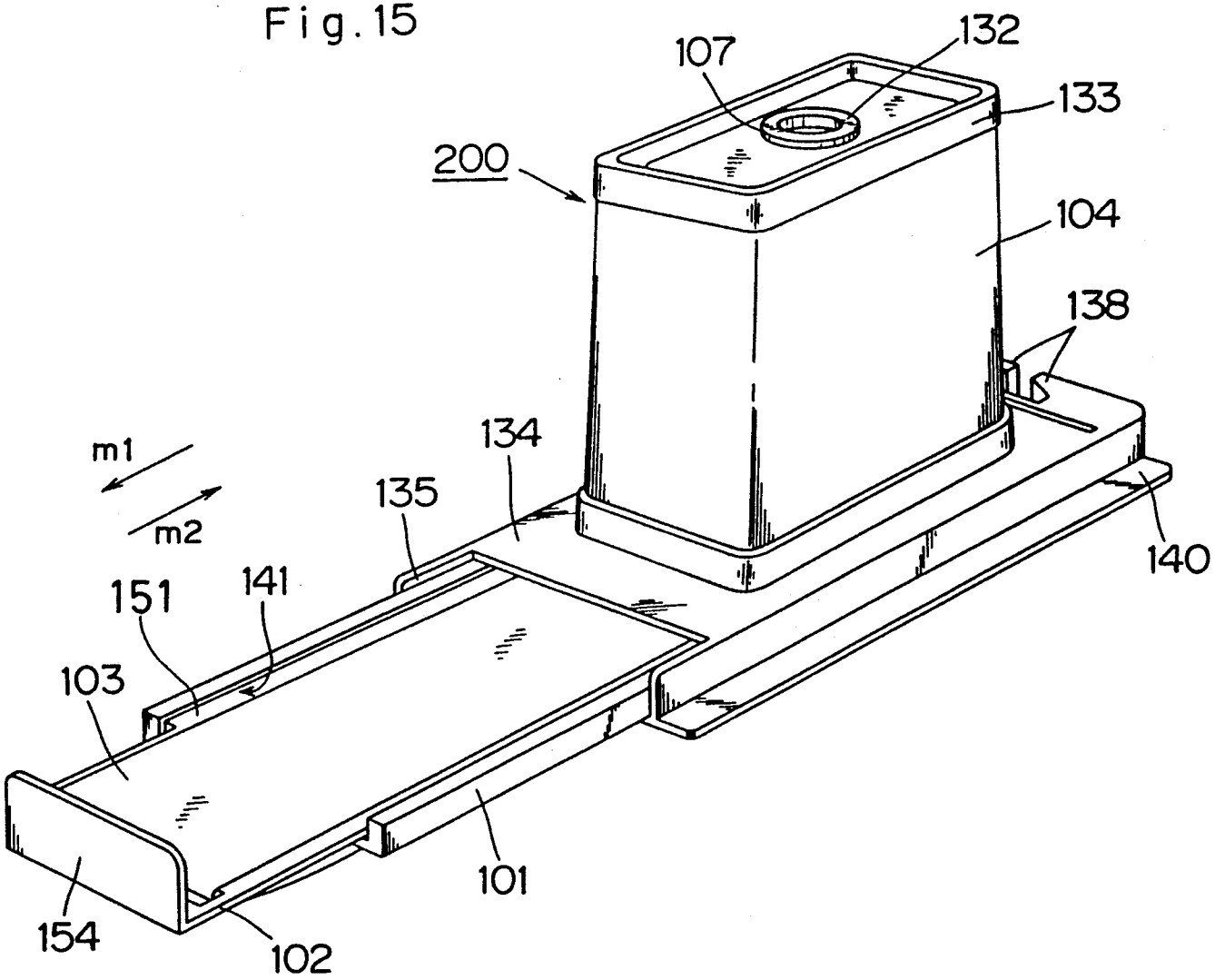
FIG. 15 is a perspective view showing a toner cartridge according to a third embodiment of the present invention.
Figure 16:
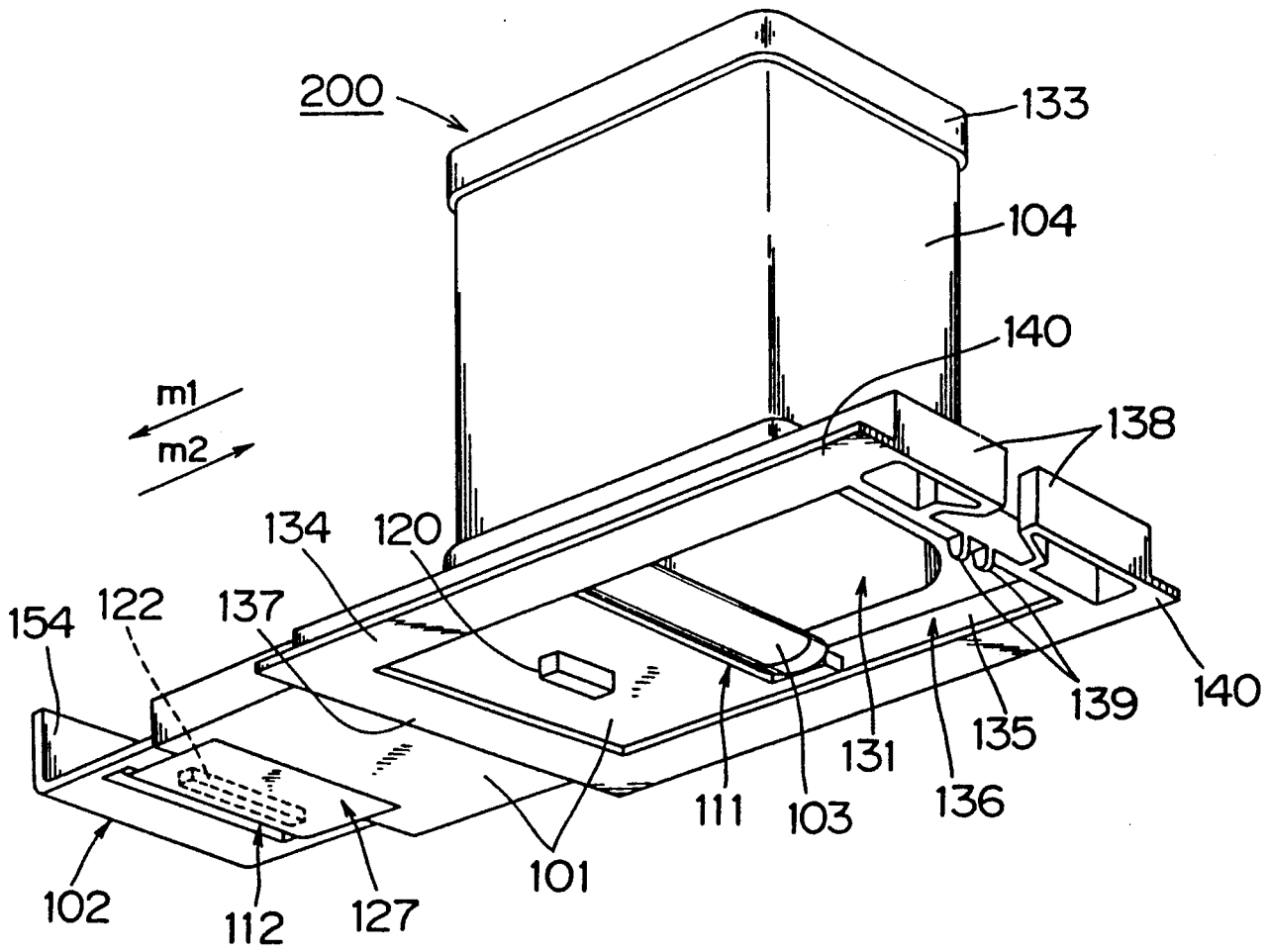
FIG. 16 is a perspective view showing the toner cartridge as viewed from below.

FIGS. 15 and 16 are perspective views showing a toner cartridge 200 according to a third embodiment of the present invention. Since the toner cartridge 200 according to the present embodiment is similar to that in the above described second embodiment, the same parts as the parts shown in FIGS. 8 to 14 are assigned the same reference numerals.

The present embodiment differs from the second embodiment in respect to the relative position of a sealing member 103 to first and second shutters 101 and 102 and a position of a projection 122 corresponding to the projection 121 in the second embodiment.

Figure 17B:
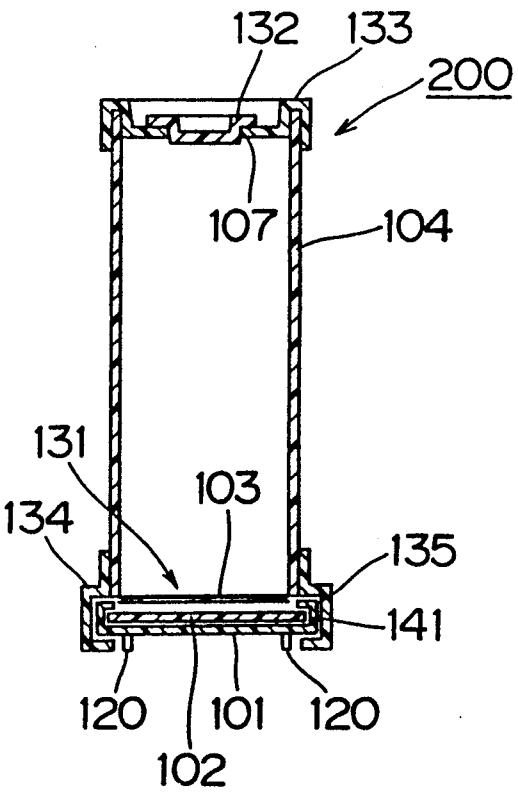
FIG. 17(*a*) is a vertical sectional view showing the toner cartridge.
Figure 17A:
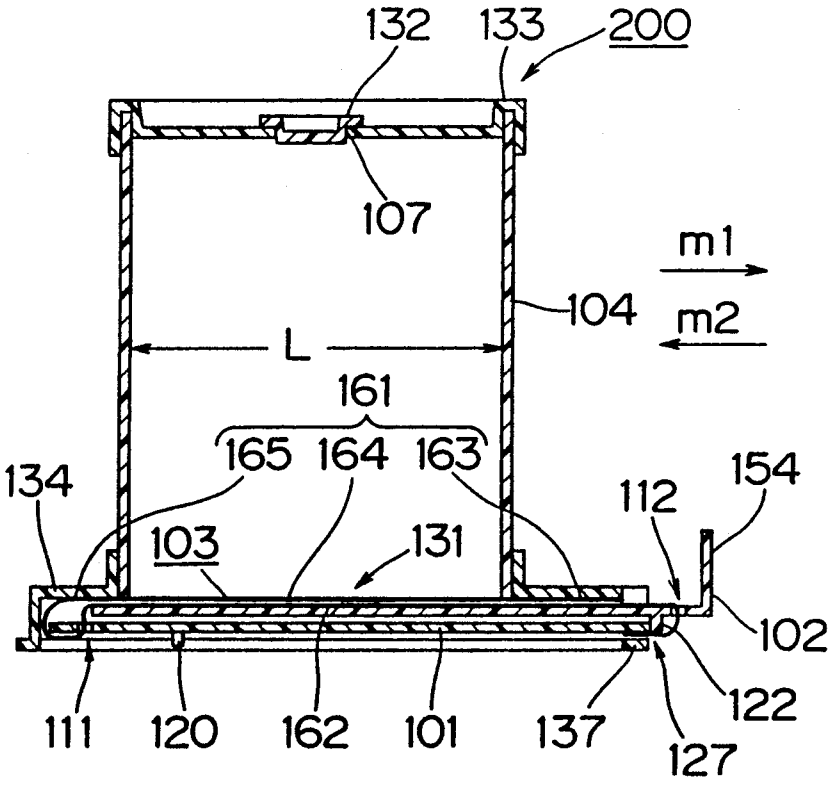

More specifically, in the present embodiment, a non-sealing part 162 of the sealing member 103 is inserted through a first slit 111 and then, passes between the second shutter 102 and a sealing part 161 of the sealing member 103, and is inserted through a second slit 112 from an upper surface to a lower surface of the second shutter 102, so that a front end of the non-sealing part 162 is fixed to a fixing part 127 provided in an end of the first shutter 101, as shown in FIG. 17.

Furthermore, the projection 122 abutted on the first shutter 101 for regulating the movement of the second shutter 102 is formed on a lower surface in a rear end of the second shutter 102. A position where the projection 122 is formed is on the upstream side of the second slit 112 in a stripping direction ml. When the second shutter 102 is pushed into a cartridge body 104, the first shutter 101 is also pushed by the function of the projection 122.

Figure 18:
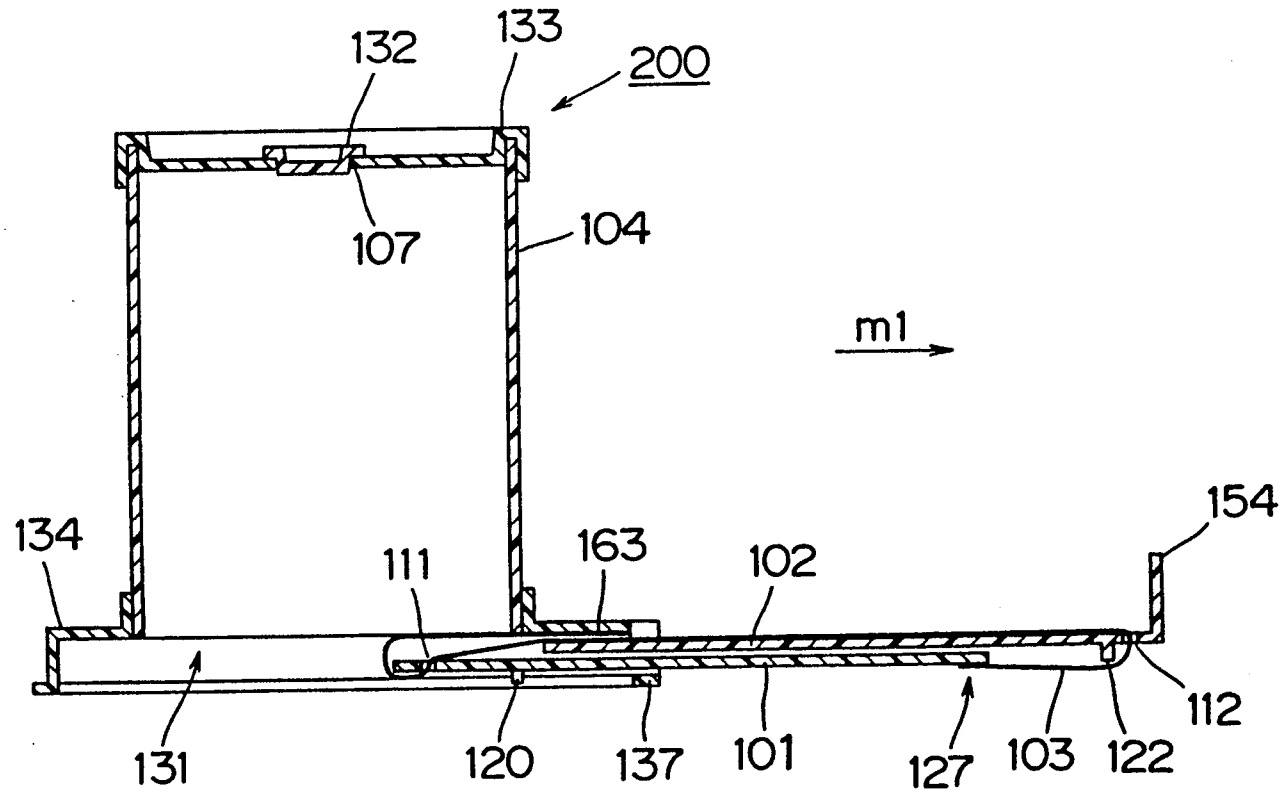
FIG. 18 is a cross sectional view showing the function of the toner cartridge at the time of stripping a sealing member.
Figure 19:
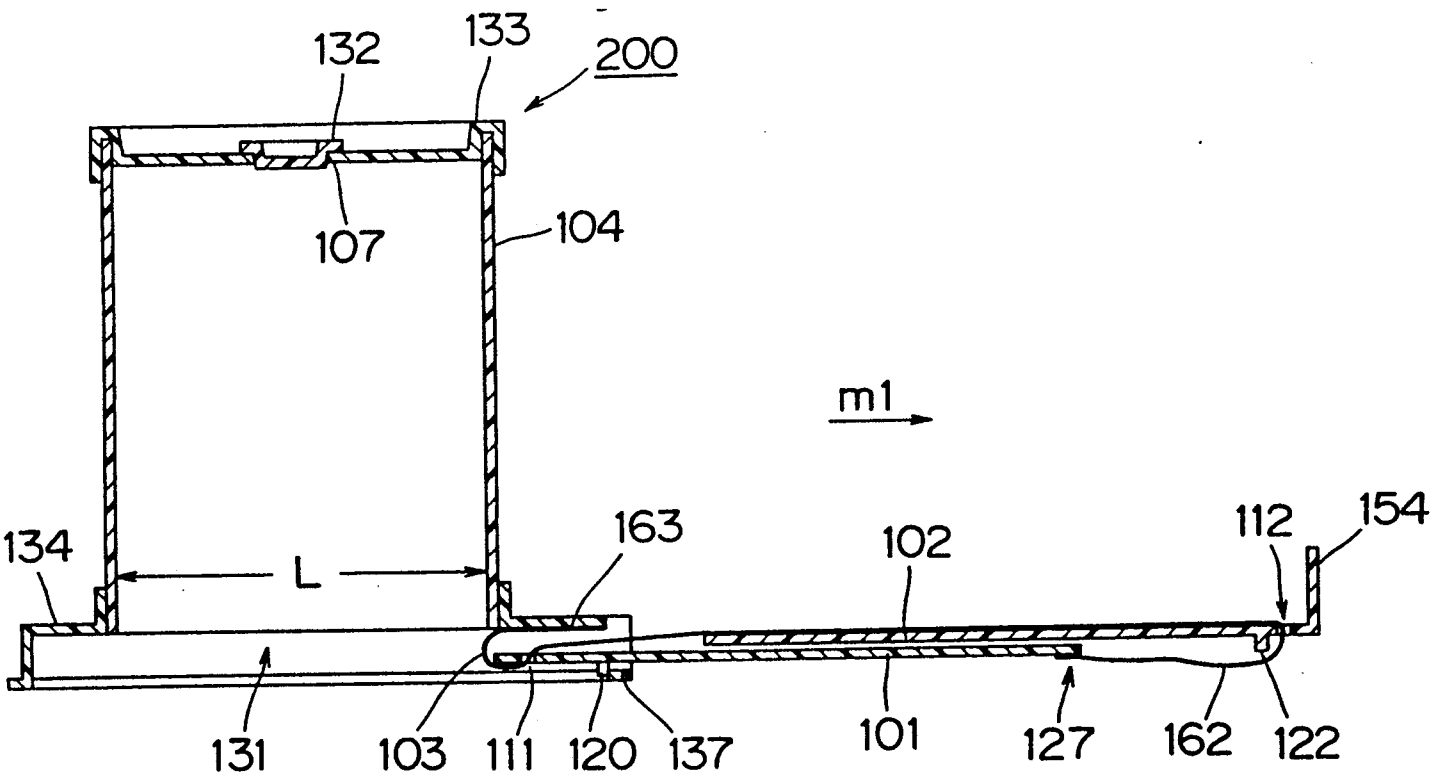
FIG. 19 is a cross sectional view showing the function of the toner cartridge at the time of stripping a sealing member.

Description is now made of the operation of the toner cartridge 200 at the time of stripping the sealing member 103 with reference to FIGS. 17 to 19. FIGS. 17 to 19 respectively correspond to FIGS. 10 to 12 showing the operation according to the above described second embodiment and thus, the detailed description of the same stripping operation is omitted.

In stripping the sealing member 103, a handle 154 of the second shutter 102 is taken, and is pulled in the stripping direction ml. At this time, the sealing member 103 receives a traction force by the second slit 112 in the same manner as that in the second embodiment. As a result, the sealing member 103 moves through the second slit 112 and the first slit 111. At this time, the front end of the sealing member 103 is fixed to the fixing part 127 of the first shutter 101, so that the first shutter 101 moves in the stripping direction ml later than the second shutter 102 on the principle of pulleys.

In the present embodiment, the stroke for stripping is short and a force required for stripping is relatively small, thereby to make it easy to perform toner supplying work, as in the second embodiment. In addition, when the first and second shutters 101 and 102 are opened, a surface to which toner adheres of the sealing member 103 is opposed to the second shutter 102, thereby to prevent contamination by toner.

Figure 20:
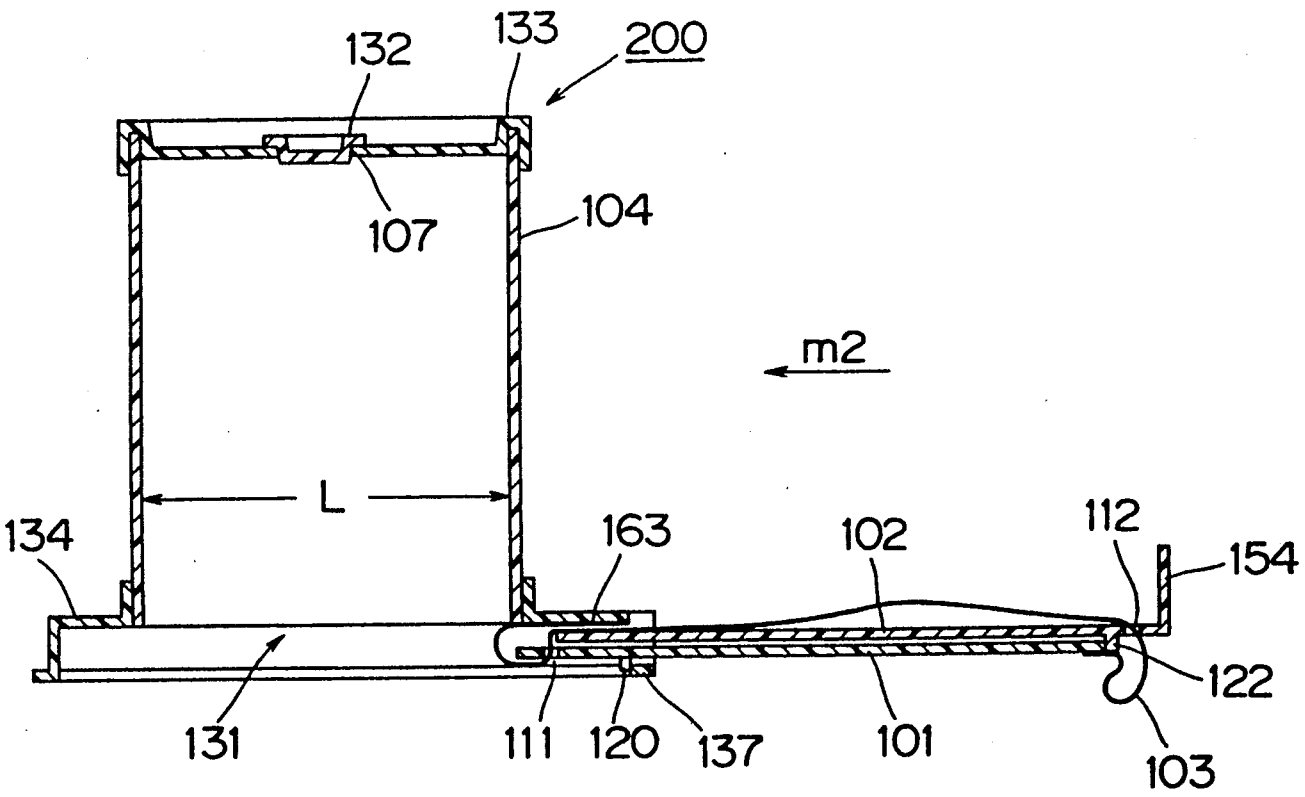
FIG. 20 is a cross sectional view showing the function of the toner cartridge at the time of containing a shutter.

After the supply of toner is completed, the second shutter 102 is pushed in a containing direction m2 in the procedure opposite to that at the time of stripping the sealing member 3, as shown in FIG. 20. Consequently, both the first and second shutters 101 and 102 are contained in the cartridge body 104, to be returned to the state shown in FIG. 17. The operation in this case is the same as that in the above described second embodiment. In addition, the first and second shutters 101 and 102 can be returned to the state shown in FIG. 17 even if the projection 122 is not provided, as in the second embodiment.

Figure 21:
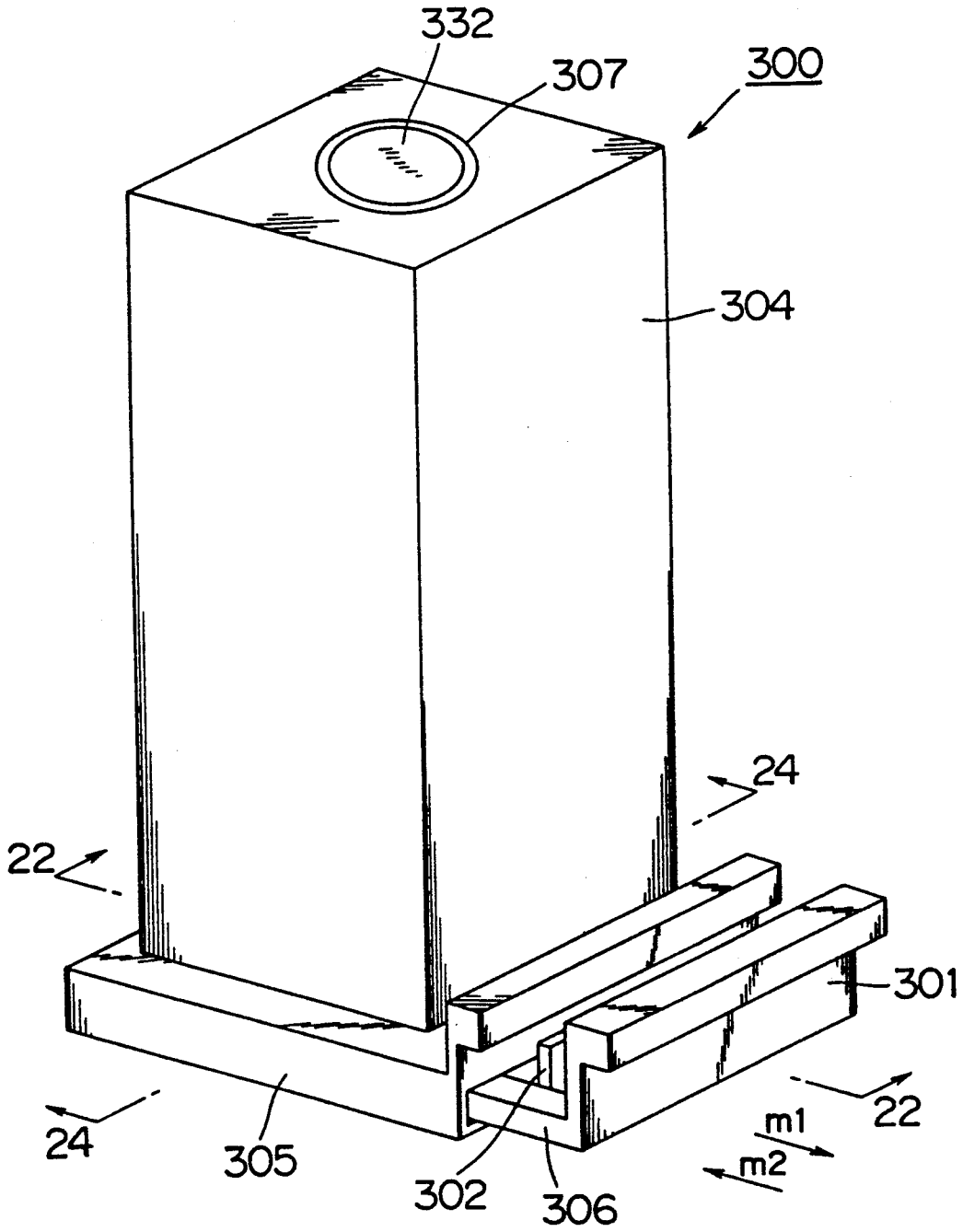
FIG. 21 is a perspective view showing a toner cartridge according to a fourth embodiment of the present invention.

FIG. 21 is a perspective view showing the construction of a toner cartridge according to a fourth embodiment of the present invention. A toner cartridge 300 has a cylindrical cartridge body 304 containing toner. An opening (not shown) is formed on, for example, a bottom surface of the cartridge body 304. This opening is sealed with a sealing member as described later. There are provided a first shutter 301 and a second shutter 302 for stripping the sealing member. The first shutter 301 is guided by first guide rails 305 provided in both sides of the opening to be slid, while the second shutter 302 is guided by second guide rails 306 provided in the first shutter 301 to be slid.

A toner fill opening 307 is formed on an upper surface of the cartridge body 304, and a removable cap 332 is fitted in the toner fill opening 307. When the cartridge body 304 is filled with toner, the cap 332 is removed to supply the toner from the toner fill opening 307. Meanwhile, when the cartridge body 304 is filled with toner, the toner fill opening 307 need not be formed if the cartridge body 304 is turned upside down to supply the toner from the opening on the lower surface shown in FIG. 21.

Figure 22:
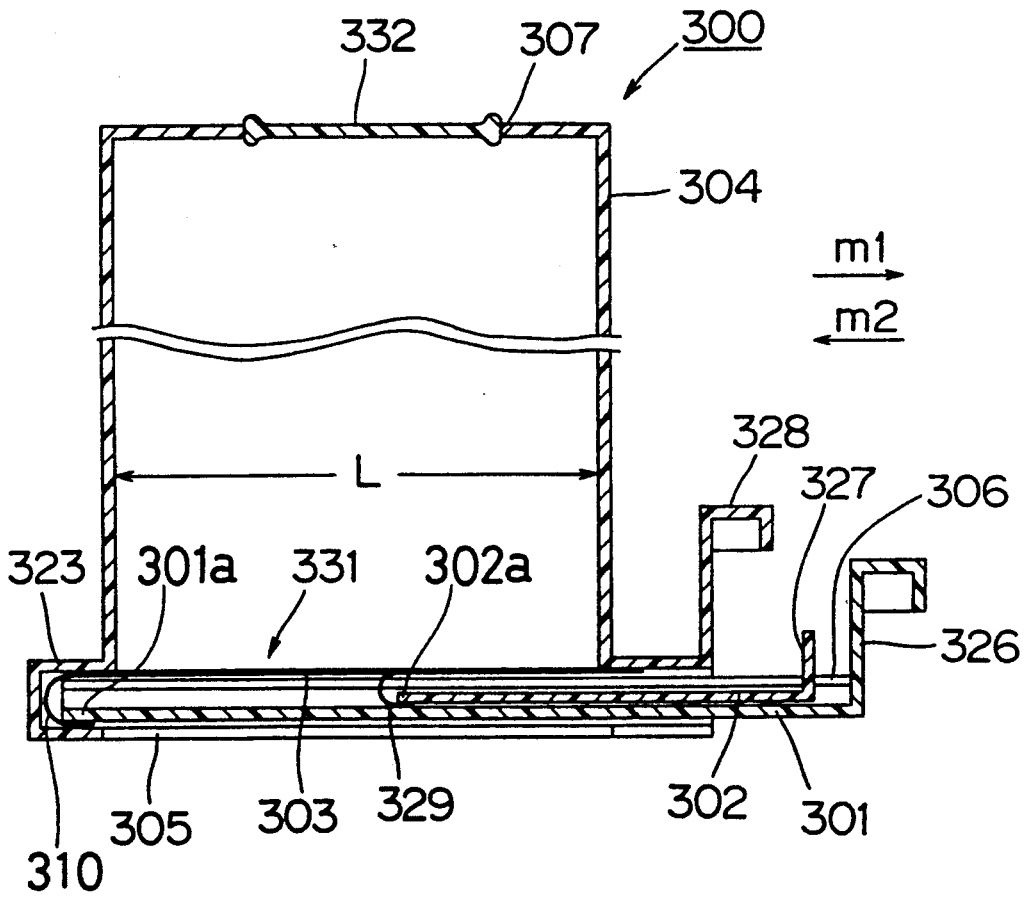
FIG. 22 is a vertical sectional view showing the toner cartridge.
Figure 23:
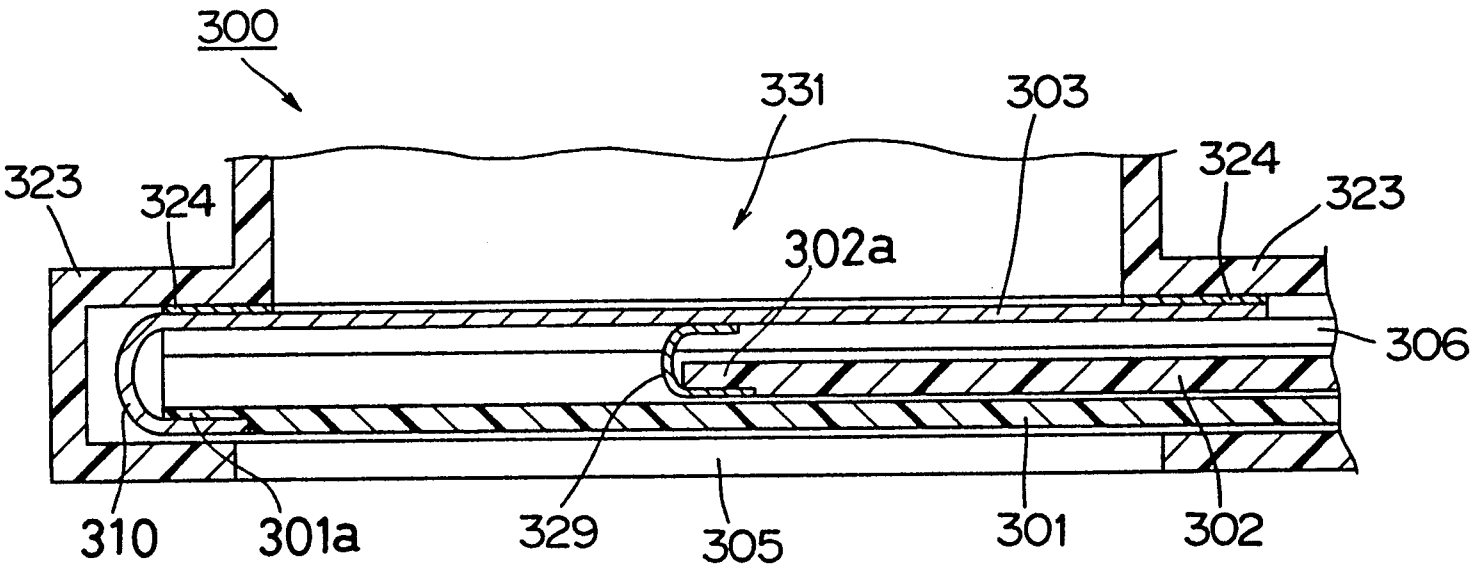
FIG. 23 is an enlarged sectional view showing main parts of the toner cartridge.
Figure 24:
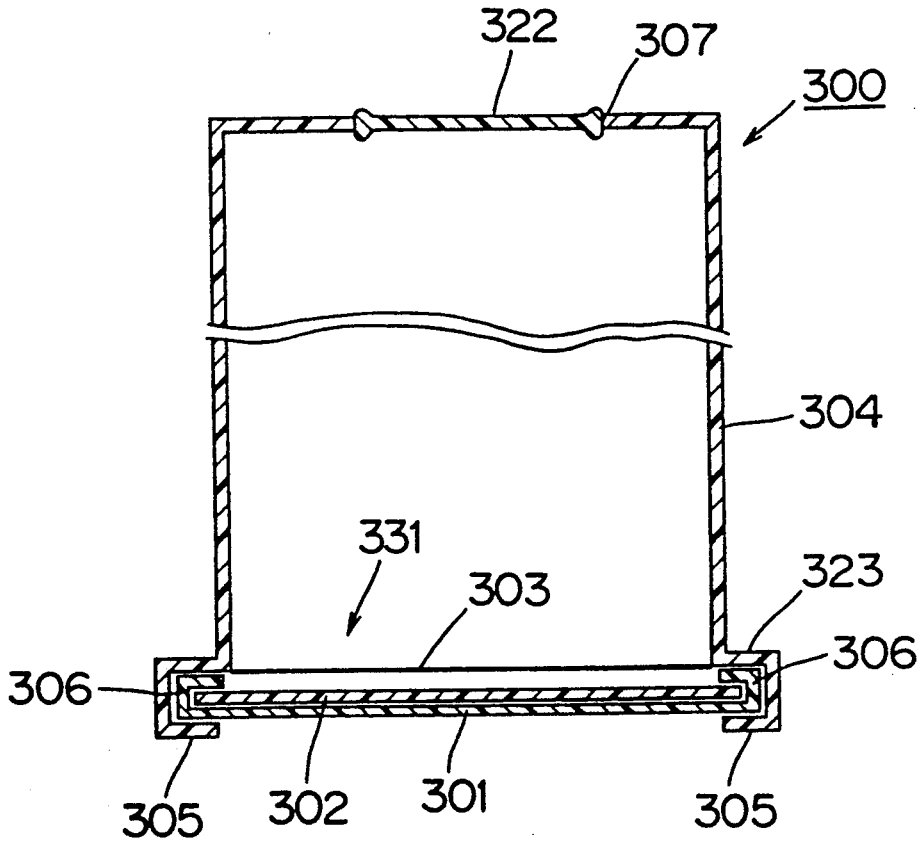
FIG. 24 is a transverse sectional view showing the toner cartridge.

FIG. 22 is a vertical sectional view showing the toner cartridge 300 taken along a line 22—22 shown in FIG. 21. In addition, FIG. 23 is an enlarged view showing main parts of FIG. 22. Further, FIG. 24 is a cutaway end view showing the toner cartridge 300 taken along a line 24—24 shown in FIG. 21.

Description is now made with reference to FIG. 22 and 23. An opening 331 is formed on a lower surface of the cartridge body 304, and the opening 331 is enclosed by a peripheral edge part 323 which is projected in the horizontal direction. A sealing member 303 is disposed so as to cover the opening 331. The periphery of the sealing member 303 is affixed to the peripheral edge part 323 with adhesives 324. The sealing member 303 is, for example, a flexible thin sheet.

Furthermore, in the peripheral edge part 323, the first guide rails 305 connected to its right and left sides are formed. The first guide rail 305 is formed in a substantially channel like shape in cross section, as shown in FIG. 24. The first guide rails 305 hold the first shutter 301 in its right and left side parts, to guide the first shutter 301 so as to be slidable in a stripping direction m1 and a containing direction m2.

The second guide rails 306 are formed in right and left sides of the first shutter 301. The second guide rail 306 is in an inverted L shape in cross section upward from the right and left sides of the first shutter 301. The second guide rails 306 hold the second shutter 302 in its right and left side parts, to guide the second shutter 302 so as to be slidable in the stripping direction m1 and the containing direction m2.

Both the second shutter 302 guided by the second guide rails 306 and the first shutter 301 guided by the first guide rail 305 respectively have operating sections 326 and 327 extending upward at approximately right angles in their rear ends (on the right side of FIG. 22). In addition, an operating section 328 is formed in a position corresponding to the operating sections 326 and 327. A worker has the operating section 328 of the cartridge body 304 in his left hand and has the operating sections 327 and 326 in his right hand in that order, to open the first shutter 301 and the second shutter 320.

An extended part 310 of the sealing member 303 is folded on the opposite side to its sealing surface, to adhere to a front end 301*a* of the first shutter 301. In addition, a connecting band 329 extending in a direction orthogonal to the stripping direction m1 is mounted on a substantially central part of the sealing member 303. This connecting band 329 adheres to a front end 302*a* of the second shutter 302. The front end 301*a* and the front end 302*a* of the first shutter 301 and the second shutter 302 respectively function as a sealing member fixing part. The extended part 310 of the sealing member 303 corresponds to first connecting means while the connecting band 329 corresponds to second connecting means.

Description is now made of an operation performed when the sealing member 303 is stripped so as to supply toner in the cartridge body 304 to a toner hopper.

Figure 25:
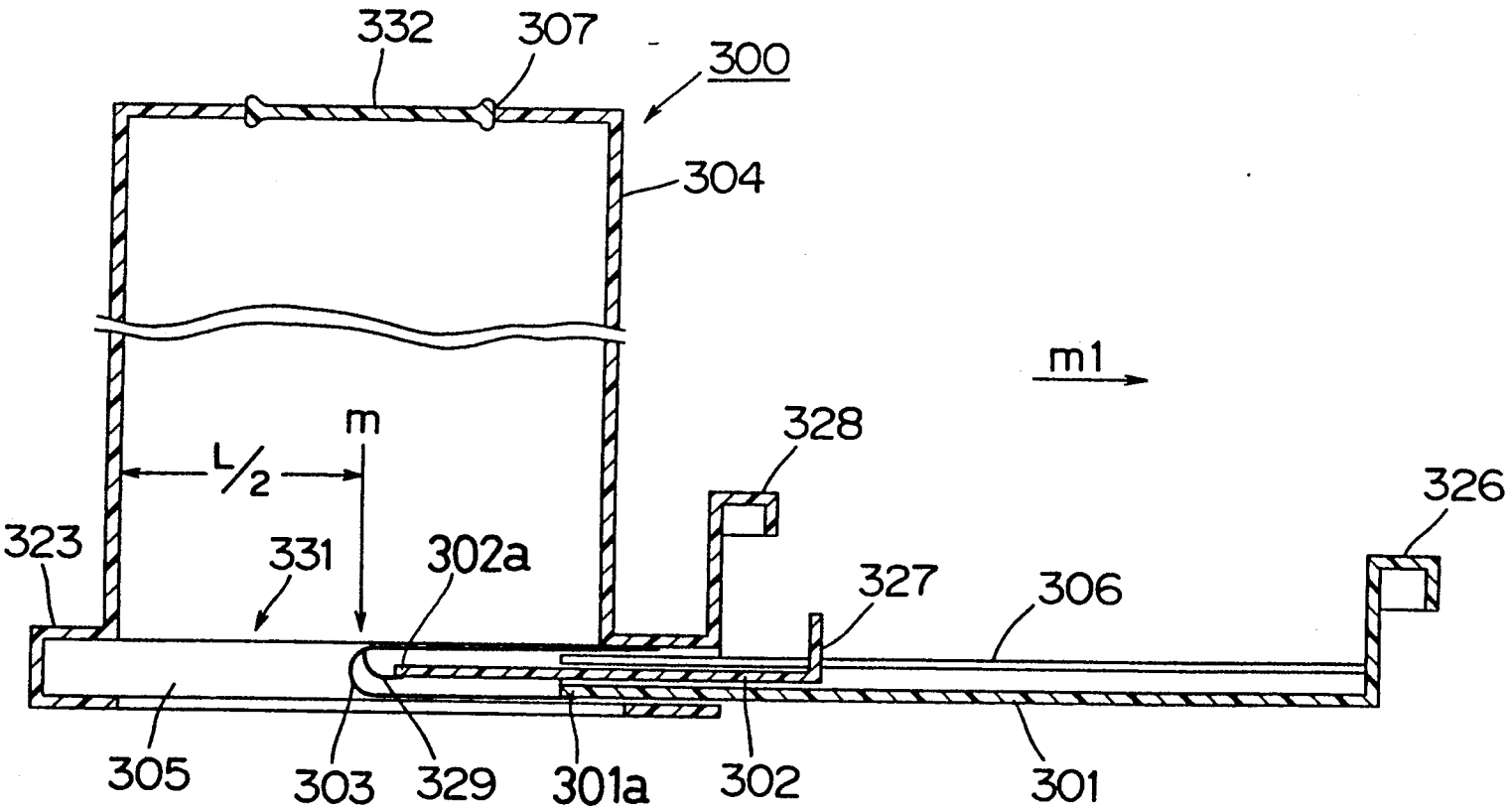
FIG. 25 is a cross sectional view showing the function of the toner cartridge at the time of stripping a sealing member.
Figure 26:
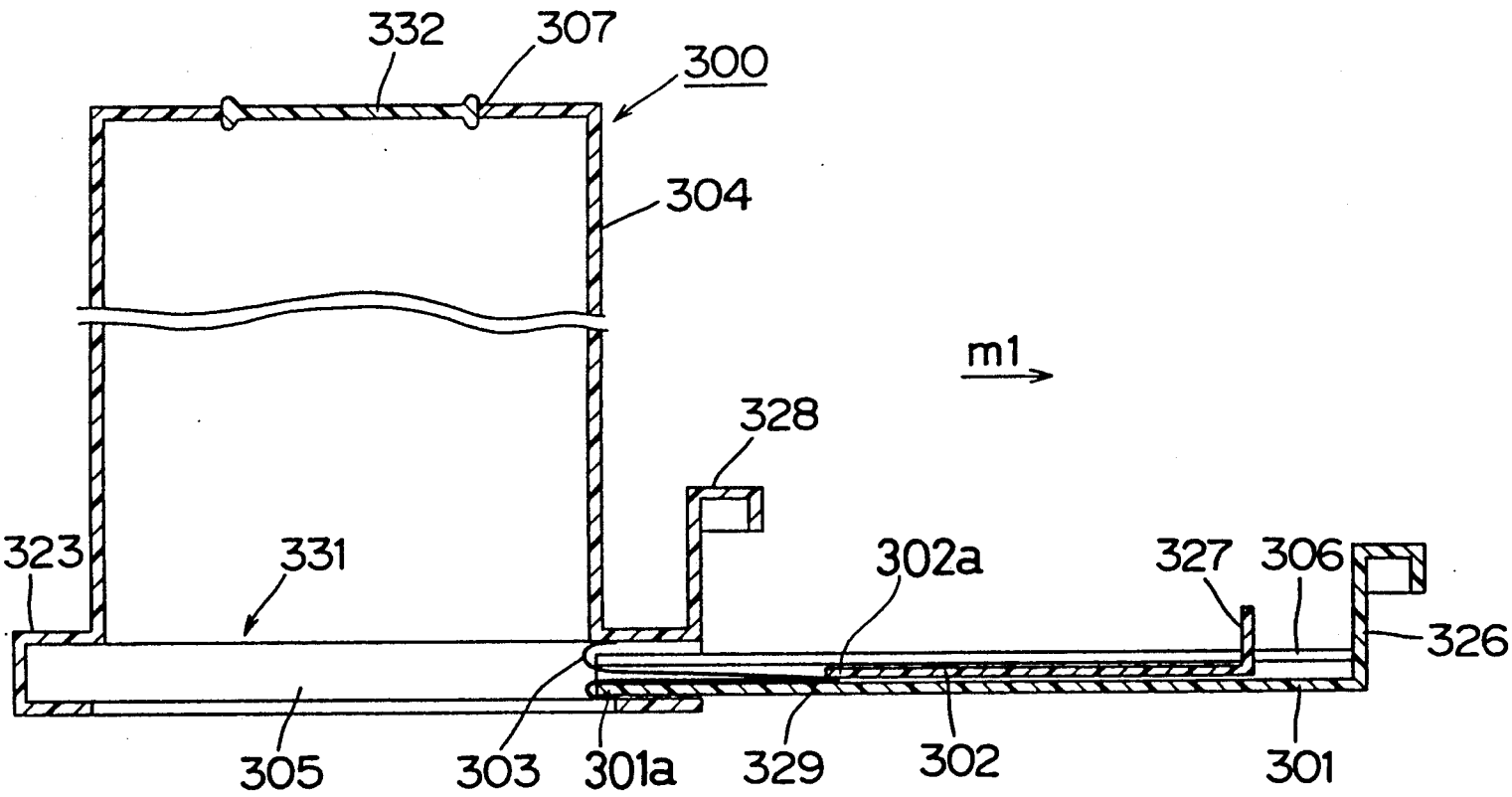
FIG. 26 is a cross sectional view showing the function of the toner cartridge at the time of stripping a sealing member.
Figure 27A:
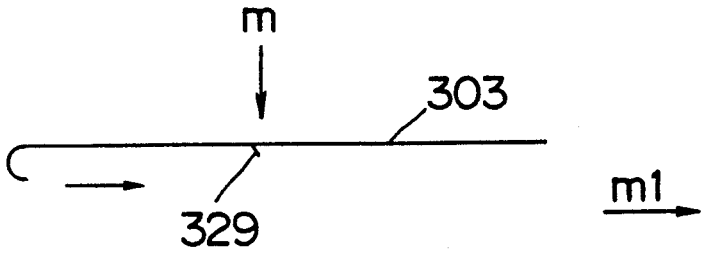
FIGS. 27A through FIG. 27E is an illustration showing the movement of a sealing member at the time of stripping the sealing member.
Figure 27B:
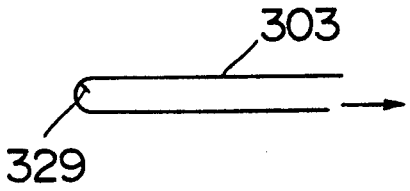
Figure 27C:
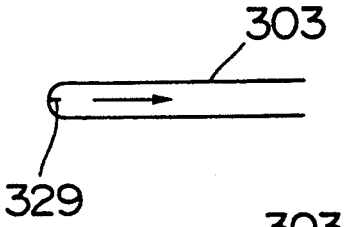
Figure 27D:
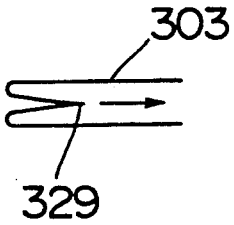
Figure 27E:
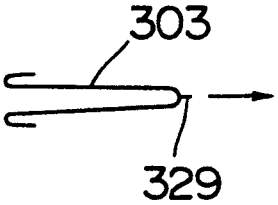

FIG. 25 is a cross sectional view showing the toner cartridge 300 in a state where the sealing member 303 is stripped from a position where stripping is started to a middle position for stripping m, and FIG. 26 is a cross sectional view showing the toner cartridge 300 in a state where the sealing member 303 is completely stripped to a position where stripping is completed.

As shown in FIG. 25, the first shutter 301 is pulled in the stripping direction m1, thereby to make it possible to strip the sealing member 303 from the position where stripping is started to the middle position for stripping m. In addition, as shown in FIG. 26, the second shutter 302 is pulled in the stripping direction m1, thereby to make it possible to strip the sealing member 303 from the middle position for stripping m to the position where stripping is completed. Consequently, the opening 331 is completely opened.

FIG. 27 is an illustration showing the transition of a state of the sealing member 303 which occurs as the first shutter 301 and the second shutter 302 are opened. The front end of the sealing member 303 is folded in the opposite direction to its sealing surface, to adhere to the front end of the first shutter 301. Accordingly, from a state in FIG. 27A, the sealing member 303 is stripped sequentially from the peripheral edge part 323 from its front end toward its rear end by sliding the first shutter 301 in the stripping direction m1 to completely open the same. When the first shutter 301 is completely opened, the sealing member 303 is stripped to the middle position for stripping m which is the middle of the opening 331 (see FIG. 27B).

In this state, the second shutter 302 is then pulled in the stripping direction m1 to be opened. Consequently, a central part of the sealing member 303 is pulled through the connecting band 329 (see FIG. 27C), and the sealing member 303 is so pulled that the sealing surface is located in its inside as the second shutter 302 is slid (see FIG. 27D). When the second shutter 302 is completely opened, therefore, the opening 331 is completely opened, so that the sealing member 303 enters a state where the sealing surface is located in its inside (see FIG. 27E). Accordingly, the dirty surface of the sealing member 303, that is, the sealing surface to which toner adheres by static electricity is located in the inside of the sealing member 303, so that no toner adheres to the outer surface of the sealing member 303. Consequently, there is no possibility that clothes and the like become dirty.

Furthermore, the stroke length of the first shutter 301 is equal to the length L of the opening 331, and the stroke length of the second shutter 302 is L/2. Consequently, the stroke for stripping becomes 1.5 L. Moreover, as can be seen from FIG. 22, the length of the sealing member 303 is approximately equal to the length L of the opening 331, thereby eliminating the possibility that a large part of the sealing member is ineffective.

Additionally, the first shutter 301 may be pulled out by the length L, and the second shutter 302 is not pulled to be longer than the first shutter 301, thereby to make it possible to supply toner in a small space.

Meanwhile, the fourth embodiment can be modified in the following. More specifically, although in the above described embodiment, the guide rails 305 of the first shutter 301 are provided in the lower part of the cartridge body 304 and the guide rails 306 of the second shutter 302 are provided in the first shutter 301, the guide rails of both the shutters may be provided in the lower part of the cartridge body 304.

Furthermore, a place where the second shutter 302 and the sealing member 303 are connected to each other can be on the side of the position where stripping is started from the center of the sealing member 303 (that is, in the containing direction M2 from the middle position for stripping m) by adjusting the amounts of sliding of the first shutter 301 and the second shutter 302.

Additionally, the sealing member 303 and the connecting band 329 need not be fixed to the respective front ends of the shutters 301 and 302. For example, the sealing member 303 and the connecting band 329 may be fixed to, for example, the center of the shutter 301 in the stripping direction m1.

Meanwhile, in the second, third and fourth embodiments, there may be provided engaging means for engaging the first shutter and the second shutter with the shutter mounting body and the cartridge body, as in the first embodiment. By providing the engaging means, the first and second shutters do not slip off the cartridge when the cartridge is carried, thereby to make it possible to prevent contamination by toner.

Furthermore, although in the toner cartridge according to each of the above described embodiments, the outer shape of the cartridge body is rectangular parallelepiped, the outer shape of the cartridge body 304 may be arbitrary, for example, cylindrical or in the shape of a cylinder which is semicircular or semielliptical in cross section.

Further, there may be disposed a pulley in a position of a through hole, such as a slit or the like, for inserting the sealing member formed in the first and the second shutters so as to wind the sealing member around the pulley.

Additionally, the same construction shown in FIG. 13 can be used in the first, the third and the fourth embodiments to prevent the first shutter from stripping off the cartridge body.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A toner cartridge comprising:

a cartridge body for containing toner, said cartridge body having an opening for discharging toner;

a sealing member disposed so as to close the opening and having its periphery strippably affixed to a peripheral edge part of said opening;

first sliding means slidably provided along said opening; and second sliding means slidably provided along said opening and being provided with a through hole on the side of a starting position where stripping is started of the sealing member, said sealing member being inserted through said through hole to make it possible to tow the sealing member;

said sealing member having an extended part extended from said starting position, the extended part being inserted through said through hole formed in said second sliding means and being fixed in said first sliding means with no significant slack in the extended part.

2. The toner cartridge according to claim 1, wherein the sealing member is so folded that a surface, which is opposed to the inside of the cartridge body, of the sealing member is located in its inside in a state where stripping is terminated.

3. The toner cartridge according to claim 1, wherein said second sliding means is provided with a handle, the second sliding means being slid by operating the handle so that the sealing member is stripped with cooperating work of the second sliding means, the sealing member and the first sliding means.

4. The toner cartridge according to claim 1, wherein said second sliding means being slid, said first sliding means is given towing force by the sealing member, and the first sliding means is slid to a predetermined position in synchronism with the second sliding means and is stopped at the predetermined position, thereby to strip the sealing member to a middle position for stripping, the second sliding means also being slid after the first sliding means stops sliding so that the sealing member is stripped from the middle position for stripping to a position where stripping is terminated.

5. The toner cartridge according to claim 1, wherein first slide guiding means for guiding the first sliding means is provided in the peripheral edge part of the opening, and said first sliding means is provided with the second slide guiding means for guiding the second sliding means.

6. The toner cartridge according to claim 5, which further comprises slip preventing means for preventing the first sliding means from slipping off the cartridge body.

7. The toner cartridge according to claim 5, which further comprises slip preventing means for preventing the second sliding means from slipping off the cartridge body.

8. The toner cartridge according to claim 5, wherein said second sliding means is provided with a handle, the second sliding means being slid by operating the handle to give towing force to the first sliding means through the sealing member so that said first sliding means is slid in synchronism with the sliding movement of the second sliding means.

9. The toner cartridge according to claim 1, which further comprises slip preventing means for preventing the first sliding means from slipping off the cartridge body.

10. The toner cartridge according to claim 1, which further comprises slip preventing means for preventing the second sliding means from slipping off the cartridge body.

11. The toner cartridge according to claim 1, wherein said first sliding means is a shutter for opening or closing said opening.

12. The toner cartridge according to claim 1, wherein said second sliding means is a shutter for opening or closing said opening.

13. The toner cartridge according to claim 1, wherein said first sliding means and said second sliding means are shutters for opening or closing said opening, and which further comprises means for engaging the first sliding means and the second sliding means with the cartridge body with said opening being closed.

14. A toner cartridge comprising:

a cartridge body having an opening for discharging toner for containing toner;

a sealing member disposed so as to close the opening and having its periphery strippably affixed to a peripheral edge part of said opening;

first sliding means slidably provided along said opening and having a first through hole through which the sealing member can be inserted on the side of a position where stripping is started of said sealing member; and second sliding means slidably provided along said opening and having a second through hole on the side of a position where stripping is terminated of said sealing member, said sealing member having an extended part extended from the position where stripping is started, the extended part being folded on the side of the position where stripping is started, inserted through said first through hole and said second through hole, and fixed to said first sliding means.

15. The toner cartridge according to claim 14, wherein said first sliding means and said second sliding means are shutters for opening or closing said opening, and the extended part of said sealing member is passed between said first sliding means and the cartridge body, and is inserted through said first through hole on the side of the position where stripping is started of the sealing member, while being inserted through said second through hole on the side of the position where stripping is terminated of the sealing member.

16. The toner cartridge according to claim 14, wherein said first sliding means and said second sliding means are shutters for opening or closing said opening, and the extended part of said sealing member is passed between said first sliding means and said second sliding means, and is inserted through said first through hole on the side of the position where stripping is started of the sealing member, while being inserted through said second through hole on the side of the position where stripping is terminated of the sealing member.

17. The toner cartridge according to claim 14, wherein said second sliding means is provided with a handle, the second sliding means being slid by operating the handle so that the sealing member is stripped with cooperating work of the second sliding means, the sealing member and the first sliding means.

18. The toner cartridge according to claim 14, wherein first slide guiding means for guiding the first sliding means is provided in the peripheral edge part of the opening, and said first sliding means is provided with second slide guiding means for guiding the second sliding means.

19. The toner cartridge according to claim 18, which further comprises slip preventing means for preventing the first sliding means from slipping off the cartridge body.

20. The toner cartridge according to claim 18, which further comprises slip preventing means for preventing the second sliding means from slipping off the cartridge body.

21. The toner cartridge according to claim 18, wherein said second sliding means is provided with a handle, the second sliding means being slid by operating the handle to give towing force to the first sliding means through the sealing member so that said first sliding means is slid in synchronism with the sliding movement of the second sliding means.

22. The toner cartridge according to claim 14, which further comprises slip preventing means for preventing the first sliding means from slipping off the cartridge body.

23. The toner cartridge according to claim 14, wherein said first sliding means is a shutter for opening or closing said opening.

24. The toner cartridge according to claim 14, wherein said second sliding means is a shutter for opening or closing said opening.

25. The toner cartridge according to claim 14, wherein said first sliding means and said second sliding means are shutters for opening or closing the opening, and which further comprises means for engaging said first sliding means and said second sliding means with the cartridge body with the opening being closed.

26. A toner cartridge comprising:

a cartridge body having an opening for discharging toner for containing toner;

a sealing member disposed so as to close the opening and having its periphery strippably affixed to a peripheral edge part of said opening;

first sliding means slidably provided along said opening and capable of displacing a sealing member fixing part for fixing said sealing member over a length in the stripping direction of said opening;

second sliding means slidably provided along said opening and capable of displacing a sealing member fixing part for fixing said sealing member over a length which is one-half the length in the stripping direction of said opening;

first connecting means for connecting one end of the sealing member and the sealing member fixing part of said first sliding means; and second connecting means for connecting a part, in a substantially central part of said opening, of the sealing member and the sealing member fixing part of said second sliding means.

27. The toner cartridge according to claim 26, wherein the sealing member fixing part of said first sliding means is a front end of the first sliding means.

28. The toner cartridge according to claim 26, wherein the sealing member fixing part of said second sliding means is a front end of the second sliding means.

29. The toner cartridge according to claim 26, wherein said first connecting means is an extended part formed by extending the sealing member.

30. The toner cartridge according to claim 26, wherein first slide guiding means for guiding the first sliding means is provided in the peripheral edge part of the opening, and said first sliding means is provided with second slide guiding means for guiding the second sliding means.

31. The toner cartridge according to claim 26, wherein said first sliding means and said second sliding means are respectively provided with a handle.

32. The toner cartridge according to claim 26, wherein said first sliding means is a shutter for opening or closing said opening.

33. The toner cartridge according to claim 26, wherein said second sliding means is a shutter for opening or closing said opening.

34. A toner cartridge comprising:

a cartridge body for containing toner, said cartridge body having an opening for discharging toner;

a sealing member disposed so as to close the opening and having its periphery strippably affixed to a peripheral edge part of said opening;

first stripping means slidably provided along said opening for stripping the sealing member and engaging the sealing member such that the stroke for stripping the sealing member is twice the length to strip the sealing member, beginning at its front end, from a starting position where stripping is started to a middle position for stripping; and second stripping means slidably provided along said opening for stripping the sealing member from said middle position for stripping to a position where stripping is terminated, said second stripping means being operable to fold the sealing member such that a surface of the sealing member which is opposed to the inside of the cartridge body is located in its inside while stripping the sealing member such that the length to strip the sealing member and the stroke for stripping the sealing member are equal to each other.

35. The toner cartridge according to claim 34, wherein said first stripping means comprises first sliding means slidably provided along said opening and second sliding means slidably provided along said opening and being provided with a through hole capable of inserting and towing the sealing member on the side of a position where stripping is started of the sealing member;

said second stripping means has said second sliding means; and said sealing member has an extended part extended from the position where stripping is started, the extended part being inserted through the through hole formed in said second sliding means and fixed to said first sliding means.

36. A method of stripping a sealing member affixed to an opening formed in a cartridge body for containing toner, comprising the steps of:

providing first sliding means which is slidable along said opening;

providing second sliding means which is slidable along said opening and having a through hole through which the sealing member can be inserted;

pulling an end on the side of a position where stripping is started of the sealing member by the first sliding means, to strip the sealing member to a middle position for stripping with cooperating work of said first sliding means and said second sliding means; and pulling said second sliding means in a state where a portion between the end on the side of said position where stripping is started and a part in said middle position for stripping of the sealing member is inserted through said through hole, to strip the sealing member to a position where stripping is terminated.

37. A toner cartridge comprising:

a cartridge body for containing toner, said cartridge body having an opening for discharging toner;

a sealing member disposed so as to close the opening and having its periphery strippably affixed to a peripheral edge part of said opening;

first sliding means slidably provided along said opening; and second sliding means slidably provided along said opening, and being provided with a through hole on the side of a starting position where stripping is started of the sealing member, said sealing member being inserted through said through hole to make it possible to tow the sealing member;

said sealing member having an extended part extended from said starting position the extended part being inserted through said through hole formed in said second sliding means and being fixed in said first sliding means;

said second sliding means being slid, said first sliding means is given towing force by the sealing member, and the first sliding means is slid to a predetermined position in synchronism with the second sliding means and is stopped at the predetermined position, thereby to strip the sealing member to a middle position for stripping, the second sliding means also being slid after the first sliding means stops sliding so that the sealing member is stripped from the middle position for stripping to a position where stripping is terminated.

38. A toner cartridge comprising:

a cartridge body for containing toner, said cartridge body having an opening for discharging toner;

a sealing member disposed so as to close the opening and having its periphery strippably affixed to a peripheral edge part of said opening;

first slide guiding means provided in the peripheral edge part of the opening;

first sliding means slidably provided along said opening and being guided by said first slide guiding means;

second slide guiding means provided in said first sliding means;

second sliding means slidably provided along said opening and being guided by said second slide guiding means, said second sliding means provided with a through hole on the side of a starting position where stripping of the sealing member is started, said sealing member being inserted through said through hole to make it possible to tow the sealing member; and a handle provided in said second sliding means, said sealing member having an extended part extended from said starting position where stripping is started, the extended part being inserted through said through hole formed in said second sliding means and being fixed in said first sliding means;

the second sliding means being slid by operating the handle to give towing force to the first sliding means through the sealing member so that said first sliding means is slid in synchronism with the sliding movement of the second sliding means.

39. A toner cartridge comprising:

a cartridge body for containing toner, said cartridge body having an opening for discharging toner;

a sealing member disposed so as to close the opening and having its periphery strippably affixed to a peripheral edge part of said opening;

first sliding means slidably provided along said opening; and second sliding means slidably provided along said opening, said second sliding means including a shutter for opening and closing said opening, said second sliding means having a through hole on the side of a starting position where stripping of the sealing member is started, through which said sealing member is to be inserted to make it possible to tow the sealing member;

said sealing member having an extended part extended from said starting position, the extended part being inserted through said through hole formed in said second sliding means and being fixed in said first sliding means.

40. The toner cartridge according to claim 39, wherein said first sliding means is a shutter which opens or closes said opening, and means for engaging the first sliding means and the second sliding means with the cartridge body with said opening being closed.

* * * * *